US005869214A

United States Patent [19]

Anzai et al.

[11] Patent Number: 5,869,214

[45] Date of Patent: Feb. 9, 1999

[54] COLOR IMAGE FORMING APPARATUS AND COLOR IMAGE FORMING METHOD THEREOF

[75] Inventors: Masayasu Anzai; Yoshihiro Gunji; Kozi Kato; Shin-ichi Nishino; Nobuyoshi Hoshi; Teruaki Mitsuya, all of Ibaraki, Japan

[73] Assignee: Hitachi Koki Co., Ltd., Tokyo, Japan

[21] Appl. No.: 895,991

[22] Filed: Jul. 17, 1997

[30] Foreign Application Priority Data

Jul. 19, 1996 [JP] Japan ..... 8-190943

[51] Int. Cl.[6] ..... G03G 13/01

[52] U.S. Cl. ..... 430/47; 399/223

[58] Field of Search ..... 430/42, 45, 47; 399/223

[56] References Cited

U.S. PATENT DOCUMENTS

| | | | |
|---|---|---|---|
| 4,078,929 | 3/1978 | Gundlach | 96/1.2 |
| 4,831,408 | 5/1989 | Yoshikawa et al. | 430/42 |
| 4,948,686 | 8/1990 | Koch et al. | 430/42 |
| 4,984,021 | 1/1991 | Williams | 355/245 |
| 5,061,969 | 10/1991 | Parker et al. | 355/328 |

FOREIGN PATENT DOCUMENTS

| | | | |
|---|---|---|---|
| 4316287A1 | 11/1993 | Germany . | |
| 55-83070 | 6/1980 | Japan | G03G 15/01 |
| 57-147655 | 9/1982 | Japan | G03G 13/09 |
| 6-36110 | 5/1994 | Japan | G03G 15/01 |

*Primary Examiner*—John Goodrow

*Attorney, Agent, or Firm*—Sughrue, Mion, Zinn, Macpeak & Seas, PLLC

[57] ABSTRACT

A dielectric belt 24 is retracted from a photoreceptor 2 before printing, and electrophotographic processes including a process of forming an electrostatic latent image, a developing process and a cleaning process except for a transferring process are repeated. During the repetition of the electrophotographic processes, a surface electric potential in the background of the photoreceptor 2 is measured by the electric potential sensor 10. Alternatively, a quantity of toner adhering to the background of the photoreceptor 2 is measured by the toner sensor 37 and the toner electric charge sensor 36. When the measured values are lower than the reference values, it is judged that no fringe image is generated in the recording condition, and the printing operation is carried out.

6 Claims, 12 Drawing Sheets

FIG. 5A ORIGINAL IMAGE
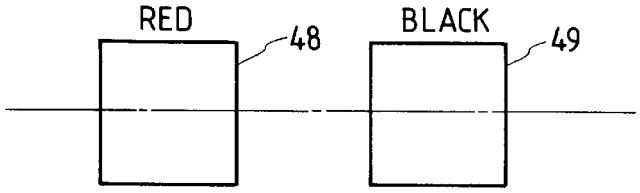
FIG. 5B SIGNAL CURRENT
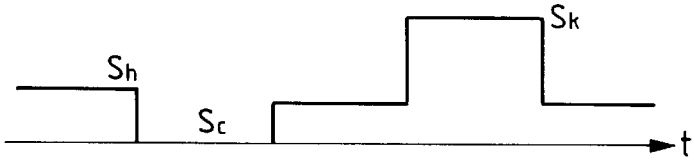
FIG. 5C LIGHT QUANTITY
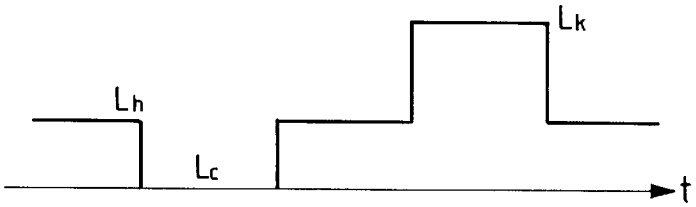
FIG. 5D LATENT IMAGE CHARGE (VOLTAGE)
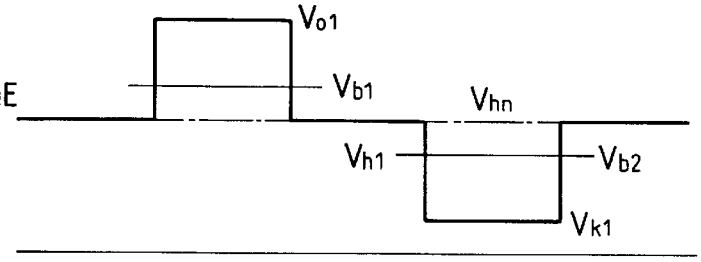
FIG. 5E LATENT IMAGE ELECTRIC FIELD
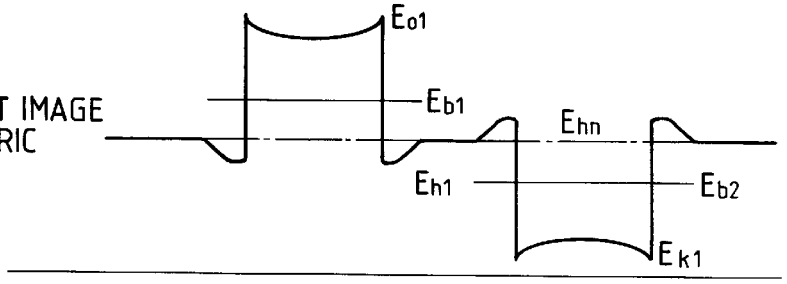

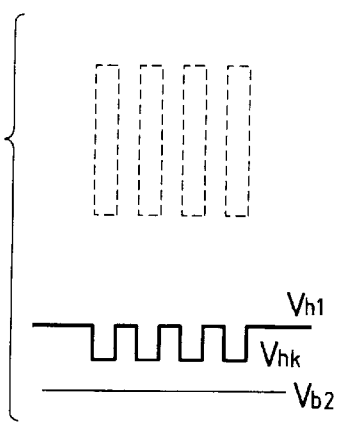
FIG. 17A
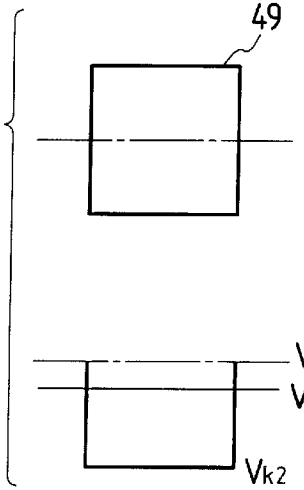
FIG. 17B
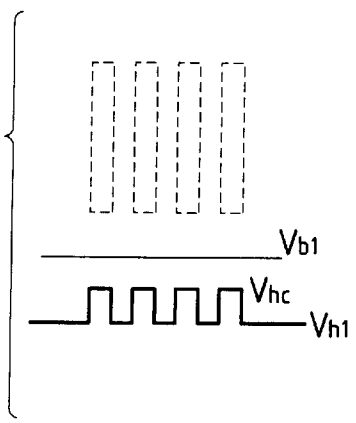
FIG. 17C
FIG. 17D
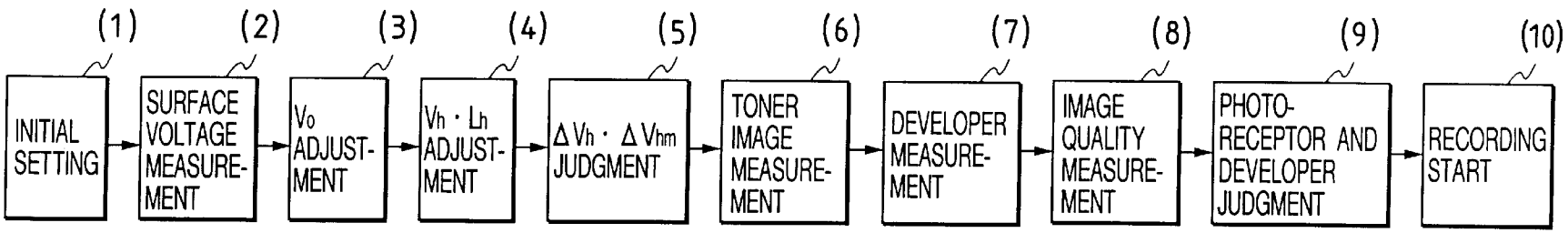
FIG. 18

COLOR IMAGE FORMING APPARATUS AND COLOR IMAGE FORMING METHOD THEREOF

BACKGROUND OF THE INVENTION

1. Field of the Invention

The present invention relates to a color image forming apparatus and a color image forming method thereof to form a color toner image on a recording medium such as a sheet of paper by an electrophotographic method or an electrostatic recording method.

2. Description of the Related Art

Conventionally, there is provided an electrophotographic method or an electrostatic recording method by which a two-color or a multi-color image can be printed when an electric charge latent image of multi-value is formed on a photoconductive photoreceptor or a dielectric body and the thus formed latent image is printed on a sheet of paper using a plurality of toners of different colors. These methods are disclosed in Japanese Examined Patent Publication No. 6-36110, Japanese Unexamined Patent Publication Nos. 55-83070 and 57-147655, and U.S. Pat. Nos. 4,078,929, 4,984,021 and 5,061,969.

However, according to the conventional image forming methods, depending upon an image forming pattern, there is a possibility that an image, which is not an image to be originally formed, is developed. Therefore, it is difficult to continue to conduct a normal image forming operation over a long period of time. In order to solve the above problems, it is necessary to print an actual image so as to confirm a state of the formation of an image. For this reason, recording paper and toner are wasted, and further it takes a long period of time for the formation of a normal image.

SUMMARY OF THE INVENTION

The present invention has been accomplished to solve the conventional problems. It is an object of the present invention to provide a color image forming apparatus and a color image forming method thereof characterized in that: it is diagnosed that the image forming apparatus is in a state in which only the information to be recorded can be printed by the image forming apparatus, so that recording paper and toner can not be wasted, and confirmation work of printing can be reduced or completely avoided.

In order to accomplish the above object, the first embodiment of invention is to provide a color image forming apparatus comprising:

- a latent image forming means for forming an electrostatic latent image having at least three electric potential levels, on a first recording body;
- a developing means for developing the latent image with toner, the polarity of which is different from that of the latent image, so as to form at least a two-color toner image;
- a transfer means for transferring the toner image on a second recording body;
- a cleaning means for removing residual toner and electric charge from the first recording body, wherein a color image is continuously formed by the latent image forming means, developing means, transfer means and cleaning means.

The color image forming apparatus further comprises:

- a surface electric potential measuring means such as an electric potential sensor for measuring a surface electric potential in a region outside the latent image forming region on the first recording body;
- a comparing means such as a portion of a controller for comparing a measured value measured by the surface electric potential measuring means with a predetermined value of the surface electric potential; and
- a control means such as a controller for controlling the start of color image formation on a recording sheet when the measured value is lower than the predetermined value as a result of the comparison.

In order to accomplish the above object, the second embodiment of invention is to provide a color image forming apparatus comprising:

- a latent image forming means for forming an electrostatic latent image having at least three electric potential levels, on a first recording body;
- a developing means for developing the latent image with toner, the polarity of which is different from that of the latent image, so as to form at least a two-color toner image;
- a transfer means for transferring the toner image on a second recording body such as a sheet of paper or dielectric film;
- a cleaning means for removing residual toner and electric charge from the first recording body, wherein a color image is continuously formed by the latent image forming means, developing means, transfer means and cleaning means.

The color image forming apparatus further comprises:

- a toner adhesion quantity measuring means such as an optical toner sensor and a toner electric charge sensor for measuring a quantity of adhering toner in a region outside the latent image forming region on the first recording body;
- a comparing means such as a portion of the controller for comparing a measured value measured by the toner adhesion quantity measuring means with a predetermined value of a quantity of adhering toner; and
- a control means such as a controller for controlling the start of color image formation on a recording sheet when the measured value is lower than the predetermined value as a result of the comparison.

In order to accomplish the above object, the third embodiment of invention is to provide a color image forming method comprising:

- a latent image forming process for forming an electrostatic latent image having at least three electric potential levels, on a first recording body;
- a developing process for developing the latent image with toner, the polarity of which is different from that of the latent image, so as to form at least a two-color toner image;
- a transfer process for transferring the toner image on a second recording body such as a sheet of paper and dielectric film;
- a cleaning process for removing residual toner and electric charge from the first recording body, wherein color images are continuously formed when the processes are successively repeated.

The color image forming method further comprises:

- a surface electric potential measuring process such as an electric potential sensor for measuring a surface electric potential in a region outside the latent image forming region on the first recording body;
- a comparing process for comparing a measured value measured by the surface electric potential measuring process with a predetermined value of the surface electric potential; and a control process for controlling the start of color image formation on a recording sheet when the measured value is lower than the predetermined value as a result of the comparison.

In order to accomplish the above object, the fourth embodiment of invention is to provide a color image forming method comprising:

a latent image forming process for forming an electrostatic latent image having at least three electric potential levels, on a first recording body;

a developing process for developing the latent image with toner, the polarity of which is different from that of the latent image, so as to form at least a two-color toner image;

a transfer process for transferring the toner image on a second recording body such as a sheet of paper and dielectric film;

a cleaning process for removing residual toner and electric charge from the first recording body, wherein color images are continuously formed when the processes are successively repeated.

The color image forming method further comprises:

a toner adhesion quantity measuring process such as an optical toner sensor and a toner electric charge sensor for measuring a quantity of adhering toner in a region outside the latent image forming region on the first recording body;

a comparing process for comparing a measured value measured by the toner adhesion quantity measuring process with a predetermined value of a quantity of adhering toner; and a control process for controlling the start of color image formation on a recording sheet when the measured value is lower than the predetermined value as a result of the comparison.

BRIEF DESCRIPTION OF THE DRAWINGS

FIGS. 5A to 5E are views showing a model of the relation among the original image to be recorded, the signal current, the quantity of emitted laser beams, the distribution of latent image electric charges, and the distribution of the latent image electric field, respectively;

FIGS. 17A to 17D are schematic illustrations showing an initial pattern used in the process of initial operation suitable for executing the present invention, respectively;

FIG. 18 is a schematic illustration showing an example of the procedure of the initial operation process according to the present invention;

DETAILED DESCRIPTION OF THE PREFERRED EMBODIMENTS

According to the present invention, the above problems can be solved as follows. As described above, the present invention comprises a means for judging that a fringe image different from the information to be originally recorded is not generated in the recording condition. The present invention comprises an initial operation process in which the image forming motion is repeatedly conducted by a prescribed number of times without transferring a toner image onto the second recording body. When the printing operation is started in accordance with the result of judgment conducted in the process, it is possible to prevent the generation of a fringe image in the process of formation of a color image so that the fringe image can not be recorded.

This operation is more specifically described as follows. Before conducting a printing operation, image forming processes except for the transferring process are repeatedly conducted, that is, the processes of latent image formation, development and cleaning are repeatedly conducted. In an image forming apparatus in which a sheet of recording paper, which is the second recording body, is conveyed to a transfer section by a dielectric belt, the dielectric belt is retracted from the photoreceptor, which is the first recording body, at this time.

In this case, the information to be originally recorded is a recording condition in which a different fringe image is not generated. It is judged by measuring the photoreceptor voltage and (or) the quantity of adhering toner.

In this case, measurement of the photoreceptor voltage is conducted in such a manner that fluctuation of the electric potential on the surface of the background of the photoreceptor is directly measured by an electric potential sensor. Measurement of the quantity of adhering toner is conducted in such a manner that the quantity of adhering toner in the background of the photoreceptor is measured by an optical toner sensor or a toner electric charge sensor. In this connection, it can be said that the measurement of the quantity of adhering toner is an indirect measurement of the fluctuation of the surface electric potential in the background of the photoreceptor, that is, the measurement of the quantity of adhering toner is to measure a quantity of toner caused by photographic fog in the fringe portion.

The present invention relates to an image forming apparatus and image forming method to obtain a color image from an electric charge latent image of multi-value formed on an insulating recording body by the electrostatic recording method or electrophotographic method. In this case, the electric charge latent image of multi-value is illustrated in FIGS. 2A to 2C.

Figure 2A:
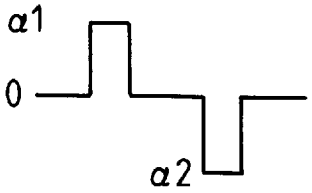
FIGS. 2A to 2C are schematic illustrations to show an electric charge level of the electric charge latent image of multi-value.

FIG. 2A is a schematic illustration showing an example of three electric charge latent images having an electric charge density $\alpha 1$ of the positive polarity and an electric charge density $\alpha 2$ of the negative polarity, wherein a boundary of the positive and negative polarity is zero (0) that corresponds to the background. That is, FIG. 2A is a schematic illustration showing an example of image formation conducted by toners of the negative and the positive polarity, the colors of which are different from each other, with respect to the electric charge density al and the electric charge density $\alpha 2$.

Figure 2B:
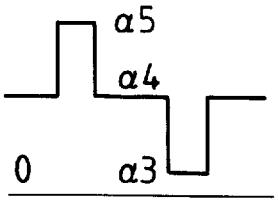

FIG. 2B is a schematic illustration showing an example of three electric charge latent images having electric charge density $\alpha 3$, $\alpha 4$ and $\alpha 5$ of the positive polarity. In this case, the electric charge density of the background is $\alpha 4$, and image formation is conducted when toner of the negative polarity and toner of the positive polarity, the colors of which are different from each other, are made to adhere onto portions corresponding to the electric charge density of $\alpha 3$ and $\alpha 5$.

Figure 2C:
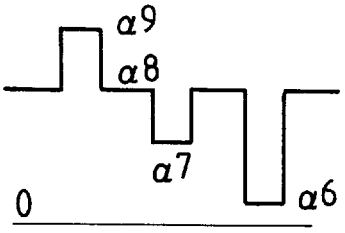

FIG. 2C is a schematic illustration showing an example of an electric charge latent image of 4 values having electric charge density $\alpha 6$, $\alpha 7$, $\alpha 8$ and $\alpha 9$ of the positive polarity. In this case, the electric charge density of the background is $\alpha 8$, and image formation is conducted when the first toner of the negative polarity is made to adhere to a portion corresponding to $\alpha 9$, the second toner of the positive polarity and the third toner of the positive polarity, the color of which is different from the colors of the first and the second toner, which are made to adhere to a portion corresponding to $\alpha 6$, and the third toner is made to adhere to portion corresponding to $\alpha 7$.

Figure 1:
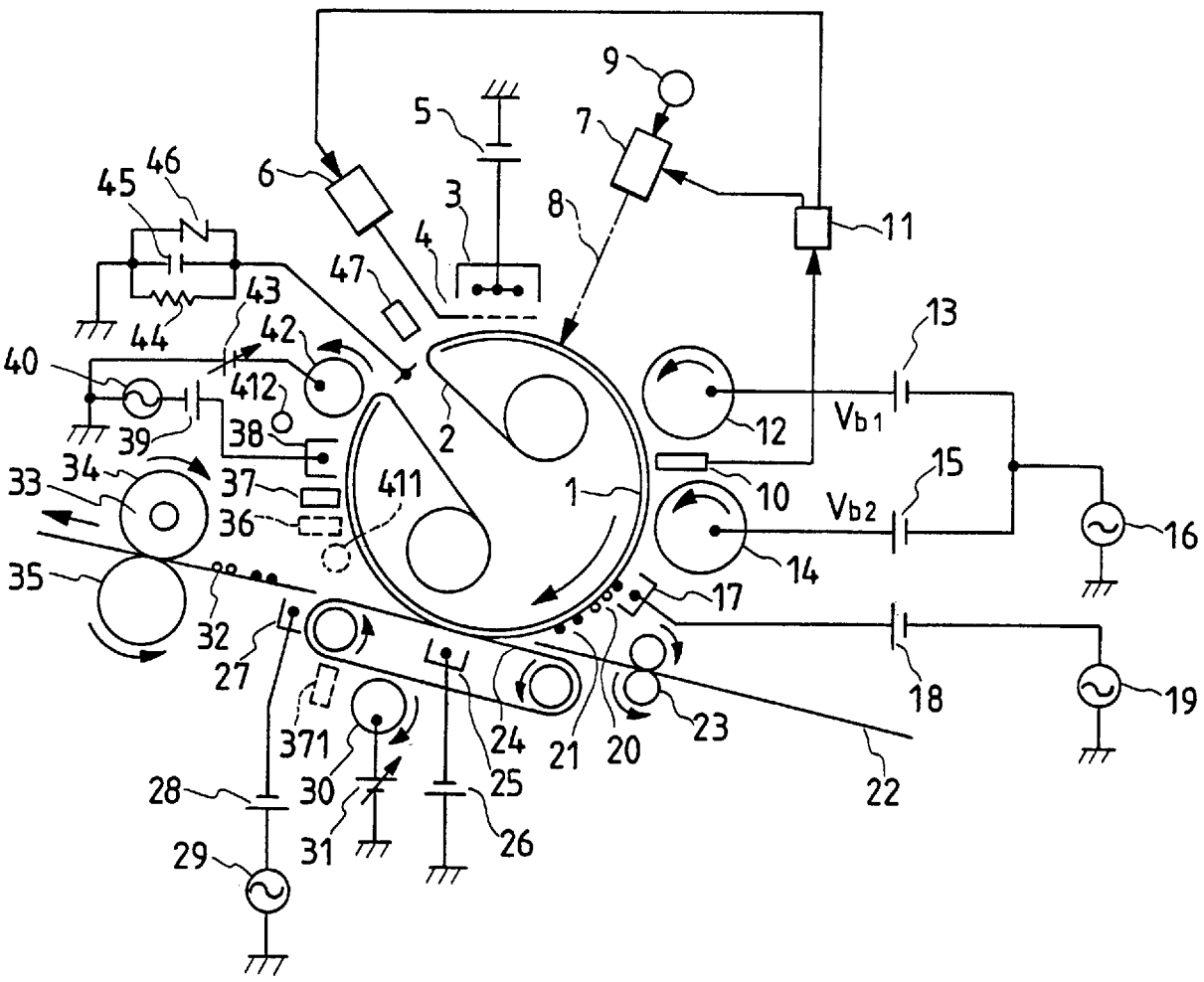
FIG. 1 is an arrangement view showing an outline of the image forming section of the two-color image forming apparatus of the embodiment of the present invention.

FIG. 1 is an arrangement view showing an outline of the image forming apparatus of the embodiment of the present invention to use an electrophotographic method by which a latent image illustrated in FIG. 2B is formed on a photoconductive photoreceptor that is the first recording body, and a color image of two colors is printed on a sheet of paper that is the second recording body.

The first recording body is composed of a drum base body 1 and a belt-shaped organic photoconductive photoreceptor 2 which is wound around the drum base body 1. When a predetermined length of the photoreceptor 2 is used, the photoreceptor 2 is fed from the drum base body 1. After it has been used, it is accommodated again in the drum base body 1. When the drum base body 1 is rotated, a surface of the photoreceptor 2 provided on the drum base body 1 is subjected to corona charge by a charger (C1) 3, so that the surface of the photoreceptor 2 can be uniformly charged.

Moving speed of the photoreceptor 2 is determined by a predetermined printing speed. In general, in this type printer, the moving speed of the photoreceptor 2 is 10 to 50 cm/s. However, it should be noted that the moving speed of the photoreceptor 2 is not limited to the specific value. The charger (C1) 3 has a grid 4 to control the charging voltage. The corona wire of the charger (C1) 3 is connected with a power supply of high voltage (H1) 5, and the grid 4 of the charger (C1) 3 is connected with a grid power supply 6.

Next, laser beams 8 emitted from a laser beam source 7 are irradiated on the surface of the photoreceptor 2. Due to the foregoing, an electric charge latent image corresponding to information to be recorded is formed on the photoreceptor 2. In this case, the laser beam source 7 is driven by a signal sent from a recording signal source 9. By the irradiation of laser beams 8, the electric latent image illustrated in FIG. 2B is formed so as to form a toner image of two types (for example, two colors).

A charging voltage of the charger (C1) 3 and a quantity of light of laser beams 8 are controlled so that the electric charge latent image can be properly formed in a predetermined range. A surface voltage of the photoreceptor 2 is measured with an electric potential sensor 10 in such a manner that a surface voltage corresponding to at least $\alpha 4$ (corresponding to the background) in FIG. 2B is measured. The grid power supply 6 and the laser beam source 7 are controlled with a controller 11 so that the voltage in the background can be maintained in a predetermined range.

The thus obtained electric charge latent image is developed with two types of color toners, for example, black toner and chromatic color toner. In order to suppress the occurrence of blur of an image caused by color mixture, and in order to obtain a sharp black image, it is preferable that the first development is conducted by means of a normal development with color toner and the second development is conducted by means of a reversal development with black toner.

A color developing roller 12, to which color toner (for example, red toner) is attracted by a magnetic force, is arranged close to the photoreceptor 2 so that the color toner can be contacted with the photoreceptor 2 or alternatively the color toner can be located close to the photoreceptor 2. This color developing roller 12 is connected to a bias power supply 13, so that bias voltage $V_{b1}$ can be impressed upon the color developing roller 12. A black developing roller 14, to which black toner is attracted by a magnetic force, is arranged close to the photoreceptor 2 so that the black toner can be contacted with the photoreceptor 2 or alternatively the black toner can be located close to the photoreceptor 2. The black developing roller 14 is connected to a bias voltage 15, so that bias voltage $V_{b2}$ can be impressed upon the black developing roller 14.

The bias power supplies 13, 15 are respectively connected to AC power supply (AC1) 16, and AC bias voltage is superimposed on the bias power supplies 13, 15. In this case, the frequency of AC power supply 16 is 200 to 5000 Hz, and the effective voltage of AC power supply 16 is 100 to 1000 V. The reason why AC bias voltage is superimposed on the bias power supplies 13, 15 is to facilitate the development, suppress the occurrence of fog, and prevent the adhesion of different toner to the roller. Therefore, the superimposition of AC bias voltage is not necessarily needed. However, in order to prevent the occurrence of fog caused when the first and the second toner mixed into the second developer adhere to the background and also in order to prevent the adhesion of mixed toner to the roller, the superimposition of AC bias voltage is effective.

Accordingly, AC voltage may be impressed only upon the black developing roller 14. When color toner is used, the polarity of which is negative, normal development is conducted by the color developing roller 12, so that a color toner image can be formed. Successively, when black toner is used, the polarity of which positive, a black toner image is formed by the black developing roller 14. The intensity of bias voltage $V_{b1}$ and the intensity of bias voltage $V_{b2}$ will be described later.

Polarities of the two color toner images developed in the above process are different from each other. Therefore, in order to make both polarities equal to each other before transferring the image, corona charging is conducted with the charger (C2) 17. In this case, the charging polarity may be either positive or negative. In this embodiment, there are provided a positive power supply of high voltage (H2) 18 and an AC power supply (AC2) 19. AC voltage, the frequency of which is 200 to 5000 Hz and the effective voltage of which is 0.5 to 3 kV, is superimposed on DC voltage, the voltage of which is 4 to 7 kV. The thus obtained voltage is impressed so as to generate a corona discharge. Superimposition of AC voltage on DC voltage is conducted for facilitating the uniformity of electric charging. Therefore, it is possible to omit superimposition of AC voltage on DC voltage. In the manner explained above, it is possible to make the charging polarity of the color toner image 20 equal to the charging polarity of the black toner image 21.

A sheet of recording paper 22 is conveyed by a sheet feed roller 23 and moved in conjunction with a dielectric belt 24. While the sheet of recording paper 22 is coming into contact with the photoreceptor 2, toner images of two colors are simultaneously transferred onto the sheet of recording paper 22 by a transfer unit 25. At this time, the transfer unit 25 is connected with a power supply (H3) 26 of high voltage. Therefore, a negative corona electric charge is given to the dielectric belt 24, so that a transfer electric field is formed. After transfer has been completed, the sheet of recording paper 32 is moved in conjunction with the dielectric belt 24. After that, the sheet of recording paper 32 is separated from the dielectric belt 24.

At this time, there is a possibility that the toner image blurs because of the occurrence of a separation discharge. In order to prevent the occurrence of a separation discharge, a negative electric charge is given to the separating section by the charger (C3) 27, so that the quantities of electric charges on both sides of the sheet of recording paper 32 can be made to be substantially equal to each other. Due to the foregoing, a sum of electric charges on the sheet of recording paper 32 becomes zero after the completion of transfer. Therefore, it is possible to prevent the occurrence of separation discharge.

The charger (C3) 27 is connected to a power supply (H4) 28 of high voltage and an AC power supply (AC3) 29. AC voltage, the frequency of which is 200 to 5000 Hz and the effective voltage of which is 0.5 to 3 kV, and DC voltage of 4 to 7 kV are superimposed on each other, and the thus superimposed voltage is impressed upon the charger (C3) 27 so as to generate corona.

The reason why AC voltage is superimposed is to facilitate the uniformity of electric charging and extend an allowable range with respect to the fluctuating factors such as a type of sheet, a state of separation, and an environmental temperature and humidity. Depending upon the operating conditions, it is possible to omit the superimposition of AC voltage on DC voltage.

In the process of transfer, toner adheres to a portion on the dielectric belt 24 between sheets of recording paper to be conveyed. Polarity of the adhering toner on the dielectric belt 24 becomes negative when an electric charge is given by the charger (C3) 27. This toner is electrically and mechanically removed by a cleaner (CL1) 30. This cleaner (CL1) 30 is connected to a cleaner power supply ($C_{b1}$) 31 and a voltage of 200 to 1000 V is impressed upon it. After the completion of transfer, the toner image on the sheet of recording paper 32 is heated and pressured by a fixing unit composed of a heater 33, heat roller 34 and backup roller 35.

Residual toner on the photoreceptor 2 is electrically charged again by a charger (C4) 38. It is preferable that the charging polarity of residual toner is determined to be a polarity sensitive to the photoreceptor 2. In general, it is preferable that the charging polarity of residual toner is the same as that given by the charger (C1) 3. In this embodiment, the charging polarity of residual toner is positive.

The charger (C4) 38 is connected to a power supply (H5) 39 of high voltage and an AC power supply (AC4) 40. AC voltage, the frequency of which is 200 to 5000 Hz and the effective voltage of which is 0.5 to 3 kV, and DC voltage of 4 to 7 kV are superimposed on each other, and the thus superimposed voltage is impressed upon the charger (C4) 38 so as to generate corona. The reason why AC voltage is superimposed is to facilitate the uniformity of electric charging and extend an allowable range with respect to the fluctuating factors such as an environmental temperature and humidity. Depending upon the operating conditions, it is possible to omit the superimposition of AC voltage on DC voltage.

After the residual electric charge on the photoreceptor 2 has been erased by the action of a discharge lamp 412, the residual toner is electrically and mechanically removed by a cleaner (CL2) 42. The cleaner (CL2) 42 is connected to a cleaner power supply ($C_{b2}$) 43, and a voltage of 200 to 1000 V, the polarity of which is reverse to the polarity of the electric charge of toner, is impressed upon the cleaner (CL2) 42. This voltage to be impressed upon the cleaner (CL2) 42 is adjusted in such a manner that the voltage is low when a quantity of toner is small in a normal printing operation and that the voltage is high when a quantity of toner is large in the case of solving a problem or in the process of initial setting. In this way, the photoreceptor 2 is prepared for the successive printing operation, and it becomes possible to conduct printing operation continuously.

An electric potential sensor 10 is used for controlling the surface voltage of the photoreceptor 2. In order to prevent the sensitivity of the electric potential sensor 10 from being affected by a change with time, it is preferable to compare an output voltage of the sensor with a reference voltage at all times. In this embodiment, a drum cap to close up a cutout portion of the photoreceptor 2 is made of conductive or semiconductive material, and when this drum cap is maintained at a predetermined voltage, the above object can be accomplished. Specifically, this voltage is detected by the electric potential sensor 10 and compared with the reference voltage.

The drum cap is connected with a constant voltage element 46, condenser 45 and resistor 44, so that it is possible to obtain a constant voltage. In this case, the resistor 44 is a safety resistor to leak an electric charge accumulated in the condenser when maintenance is conducted on the drum after the printing operation has been completed. It is preferable that a switch is added to the circuit and the resistor is activated by turning on the switch only when necessary.

The present invention has been achieved to accomplish the following objects. Before a normal printing operation, it is diagnosed whether or not the image forming apparatus is in a state in which only information to be recorded can be printed; printing operation is stopped when the printing condition is out of a normal operating range in the process of printing; and the life of a photoreceptor and developer is judged. In order to accomplish the above objects, there are provided an electric potential sensor 10, toner sensor 37 or toner electric charge sensor 36, and counter 47.

At the first stage of operation before the start of printing operation, the dielectric belt 24 is retracted so that it can not be contacted with the photoreceptor 2, or alternatively the transfer unit 25 is put into a condition in which the transfer unit 25 can not be operated, and the latent image forming process, developing process and cleaning process are repeated by a predetermined number of times under the condition that no sheets of recording paper 22 are conveyed. In this connection, in a system in which no dielectric belt 24 is used and transfer is conducted only by the corona transfer unit, the transfer unit 25 may be operated and no sheets of recording paper 22 are conveyed. In the photoreceptor 2, the charging voltage given by the charger (C1) 3 and the background voltage of which are changed by the operation of transfer corona, the aforementioned operation is preferably adopted.

During the above repetition, one of or both of the measurement of the photoreceptor voltage conducted by the electric potential sensor 10 and the measurement of a quantity of adhering toner conducted by the optical toner sensor 37 or the toner electric charge sensor 36 are used, and at the same time, the measurement of toner electric charge and resistance of developer is conducted if necessary. In accordance with the result of the above measurement, it is judged whether or not adjustment is performed so that the operation can be carried out in a normal condition, and it is also judged whether or not the result of measurement is in a range in which normal operation can be performed. In the case where the result of the measurement is in a range of normal operation, the successive printing operation is started.

In the process of a printing operation, when necessary, the electric potential of the photoreceptor is measured by the electric potential sensor 10, and also the electric charge of the toner and the resistance of the developer are measured, and adjustment is conducted so that the operation can be normally carried out. When the result of the measurement is out of the range of the normal operating condition, the printing operation is stopped. Of course, a sheet of recording paper 22 may be fed in the middle or at the last of the above initial operating process, and printing may be actually conducted on the sheet of recording paper 22.

In this connection, when a quantity of toner is measured with the toner electric charge sensor 36, the charger (C2) 17 is not operated and the discharging lamp 411 is operated, and the quantity of toner is calculated by measuring a difference between the electric potential of the toner portion and the electric potential of the peripheral portion. According to the history of printing, the above initial operation may be omitted or the time of the above initial operation may be changed. Due to the foregoing, it is possible to enhance the printing efficiency.

A counter 47 is used for calculating a quantity of toner used in the initial operation, a number of sheets of recording paper, a period of time in which the developer and the photoreceptor 2 are used, and a number of printed sheets. The result of calculation is used as data of the toner consumption, the rebate of the charge of recording sheets, the judgment of life of the developer and photoreceptor, and the corrected program of the normal operating condition in accordance with the history of printing.

In the above explanations, a method is described in which the dielectric belt 24 is retracted or the transfer unit 25 is not operated in the process of initialization. However, in the photoreceptor in which the charging voltage and the background voltage given by the charger (C1) 3 are changed by whether or not the transfer unit 25 is operated, it is preferable to conduct an initializing operation in which the dielectric belt 24 and the transfer unit 25 are operated in the same manner as that of the printing operation and only no recording sheet 22 is made to pass through the transfer unit 25. Concerning the measurement of a quantity of toner, since the toner image formed on the photoreceptor 2 is transferred onto the dielectric belt 24 at this time, the quantity of toner can be measured by the toner sensor 371.

At this time, the quantity of toner on the dielectric belt 24 is increased. Accordingly, it is preferable to enhance the cleaning capacity by raising a voltage of the cleaning unit power supply ($C_{b1}$) 31. Further, the toner sensor 371 can control the image forming apparatus as follows. The toner sensor 371 forms a measuring pattern between sheets of recording paper provided on the dielectric belt 24. Then the toner sensor 371 continuously or intermittently measures whether or not it is possible to record an image in a normal condition. As a result of the measurement, it controls the image forming apparatus.

As described above, according to the present invention, printing can be accomplished without fail, and further it is possible to suppress a waste of toner or reduce the consumption of sheets of recording paper 22, and furthermore it is possible to the enhance efficiency by reducing the printing time.

Figure 3:
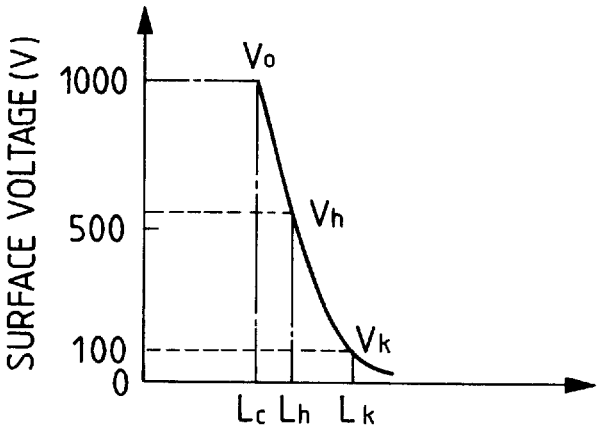
FIG. 3 is a characteristic diagram showing a relation between the quantity of laser beams and the surface voltage of a photoreceptor.

Referring to FIGS. 3 to 18, the operation and a phenomenon of each portion of the image forming apparatus will be described in detail as follows. FIG. 3 is a graph showing a relation between a quantity of the laser beams 8 and a surface voltage of the photoreceptor 2.

The charger (C1) 3 electrically charges a surface of the photoreceptor 2, so that the surface voltage can be raised to $V_0$. According to the three-level recording method of this embodiment, it is appropriate to raise the surface voltage $V_0$ to 600 to 1200 V. When the surface of the photoreceptor 2 is irradiated with laser beams, the quantity of which is changed to three values of $L_c$ (usually, zero), $L_h$ and $L_k$, the surface voltage becomes $V_0$, $V_h$ and $V_k$ in accordance with the optical attenuating characteristic of the photoreceptor 2. In this case, $V_k$ is a factor substantially determined by the residual voltage characteristic of the photoreceptor 2.

Usually, $V_k$ is 50 to 150 V. In the developing process illustrated in FIG. 1, color toner is made to adhere to the portion of $V_0$, and black toner is made to adhere to the portion of $V_k$, and the background corresponds to $V_h$. When $V_0$=1000 V and $V_k$=100 V, it is set that $V_h$=400 to 600 V. When a semiconductor laser is used for the laser beam source 7, it is possible to reduce the dimensions of the apparatus and it is also possible to reduce the manufacturing cost.

Figure 4:
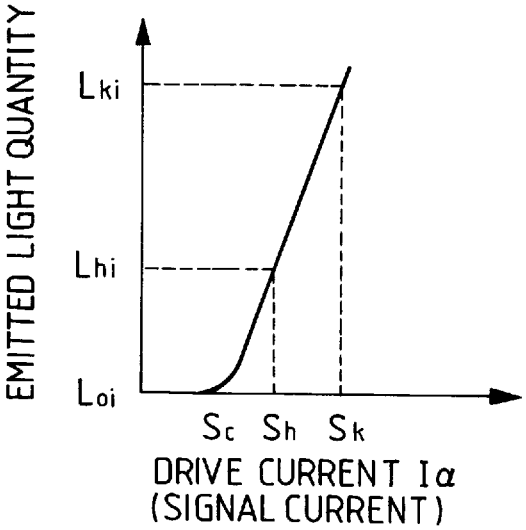
FIG. 4 is a characteristic diagram showing a relation between the drive current of a semiconductor laser and the quantity of emitted laser beams.

FIG. 4 is a graph showing a relation between a drive current (signal current) of the semiconductor laser and a quantity of light emitted by the laser. $S_c$, $S_h$ and $S_k$ shown on the graph respectively represent the signal currents of the color portion, the background portion and the black portion. $L_{0i}$, $L_{hi}$ and $L_{ki}$ represent quantities of emitted light corresponding to them.

FIGS. 5A to 5E are views showing a model of the relation among the original image to be recorded (FIG. 5A), the signal current (FIG. 5B), the quantity of emitted laser beams (FIG. 5C), the distribution of latent image electric charges (FIG. 5D) and the distribution of the latent image electric field (FIG. 5E).

When a scanning line is resolved along a one-dotted chain line in the case of recording a red portion 48 and black portion 49, a relation between the signal current and the time t is expressed in FIG. 5B. When the photoreceptor is scanned by laser beams, a quantity of irradiating light is expressed in FIG. 5C. $L_c$, $L_h$ and $L_k$ in the view respectively represent quantities of irradiating light in the red portion, the background and the black portion.

When an electric charge latent image pattern is formed on the photoreceptor by the optical scanning exposure conducted as shown in FIG. 5A, the distribution of electric charges corresponding to the one-dotted chain line shown in FIG. 5A is expressed in FIG. 5D. Reference characters in the view respectively express surface voltages when the electric charge density at each level is uniformly distributed in a portion of a large area. In the view, reference characters $V_{01}$, $V_{h1}$ and $V_{k1}$ are respectively voltages of the red portion, the background and the black portion. $V_{hn}$ is a reference voltage of the background portion. $V_{b1}$ and $V_{b2}$ are bias voltage levels to be impressed upon the color developing roller 12 and the black developing roller 14.

FIG. 5E shows a latent image electric field distribution in the developing section. In FIG. 5E, $E_{01}$, $E_{h1}$, $E_{k1}$, $E_{b1}$, $E_{b2}$ and $E_{hn}$ respectively correspond to $V_{01}$, $V_{h1}$, $V_{k1}$, $V_{b1}$, $V_{b2}$ and $V_{hn}$. Different from the electric charge distribution, the latent image electric field generates an edge effect at the end portion. $V_{b1}$ and $V_{b2}$ are determined so that redundant toner images except for information to be recorded, such as fog of an image in the background, ghost and fringe are not generated. Especially when an intensity of the electric field is close to or higher than $E_{b1}$ and $E_{b2}$ by the edge effect in the background, the toner adheres to this portion, and a fringe image is formed, which causes a problem in the image formation.

Figure 6A:
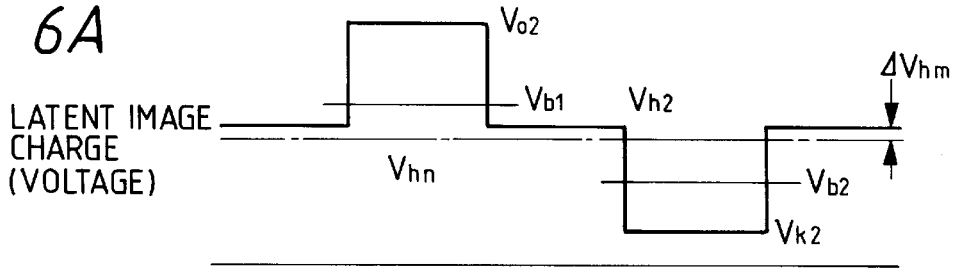
FIGS. 6A to 6C are views to explain the circumstances of a fringe image generated in the process of printing.
Figure 6B:
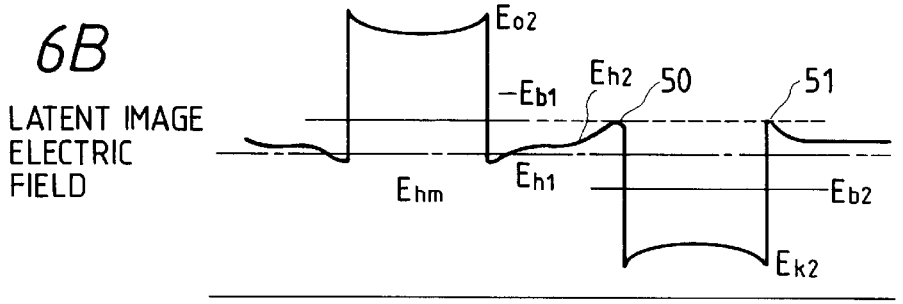
Figure 6C:
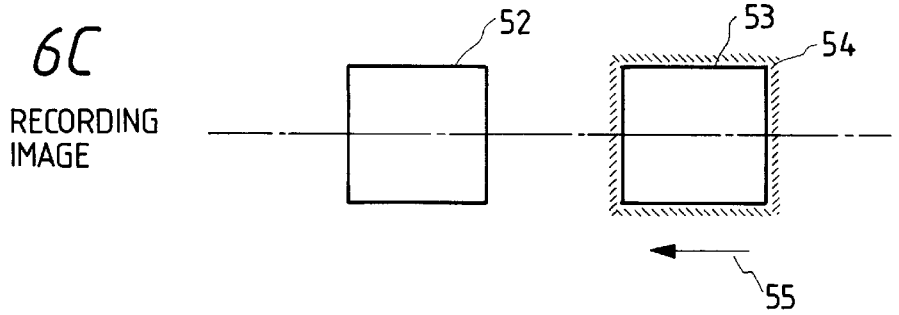

FIGS. 6A to 6C are views to explain the circumstances of a fringe image generated in the process of printing. As illustrated in FIG. 6A, when $V_0$ is raised to $V_{02}$ and the background voltage $V_{h1}$ is changed to $V_{h2}$ being shifted from the predetermined value $V_{hn}$ by $\Delta V_{hm}$, a latent image electric field illustrated in FIG. 6B is formed. Therefore, the end portion electric fields 50, 51 of the background electric field $E_{h2}$ become close to or higher than $E_{b1}$.

When this latent image is developed, as illustrated in FIG. 6C, toner adheres to not only the red toner image 52 and the black toner image 53 but also the peripheral portion of the black toner image 53, that is, red toner adheres to the peripheral portion. In this way, the fringe image 54 is formed. When developer relatively moves in the direction of an arrow 55 at this time, the fringe image 54 is markedly formed on the side indicated by the arrow. Also, fog of the background caused by red toner is increased. When $V_{h2}$ fluctuates to a value lower than $V_{hn}$, a fringe image of black toner is generated in the periphery of the red toner image 52. Therefore, fog caused by black toner is increased.

Accordingly, when a change in voltage of the background, a change in the generation of fog and an occurrence of a fringe image are measured, it is possible to judge whether or not a normal printing operation can be carried out, and the printer can be controlled in accordance with the judgment. In order to avoid an influence of the voltage fluctuation $\Delta V_{hm}$ in the background, $E_{b1}-E_{hn}$, and $E_{hn}-E_{b2}$ may be increased. On the other hand, it is necessary to increase $E_{02}-E_{b1}$, and $E_{b2}-E_{k2}$ so as to obtain an image of high density. Therefore, the increase in $E_{b1}-E_{hn}$ and $E_{hn}-E_{b2}$ is limited.

An example of setting the voltage to satisfy both of them will be explained as follows. When $V_0$=1000 V, $V_{hn}=V_{h1}$=550 V, and $V_k$=100 V, voltage setting is conducted in such a manner that $V_{b1}$=700 to 750 V, and $V_{b2}$=350 to 400 V, so that the equality of $V_{b1}-V_{hn}=V_{hn}-V_{b2}$=150 to 200 V can be satisfied. On the other hand, a voltage equivalent value of a quantity of change in the end portion in the background electric field is 50 to 100 V when it is found by changing $V_{b1}$ or $V_{b2}$ so as to check the appearance of a fringe image.

Accordingly, in order to prevent the generation of a fringe image, the value of $\Delta V_{hm}$ is maintained to be 50 to 150 V, that is, the value of $\Delta V_{hm}$ is approximately 100 V. In order to ensure a stable operation, it is appropriate that an allowance of fluctuation $\Delta V_{hm}$=50 V. That is, an allowable ratio of fluctuation is approximately 10% of $V_{hn}=V_{h1}$=550 V. In order to prevent the generation of fringe images of both the red toner image 52 and the black toner image 53, the allowable range of fluctuation is approximately ±10%.

These fluctuating values are changed according to the developing system, the developer and the developing unit setting condition. However, it was confirmed by an experiment that the allowable ratio of fluctuation was not greatly changed. Due to the foregoing, the generation of a fringe image is prevented in the present invention as follows. After it has been directly or indirectly confirmed that the fluctuating value of the surface voltage in the background is in a range of the prescribed value, or alternatively while it is directly or indirectly being confirmed that the fluctuating value of the surface voltage in the background is in a range of the prescribed value the printing operation is conducted. In this case, direct confirmation can be conducted by measuring the voltage of the background, and indirect confirmation can be conducted by measuring a quantity of toner adhering to the fringe portion or the background. The foregoing contributes to suppress the generation of fog in the background and maintain the image density stably.

Figure 7:
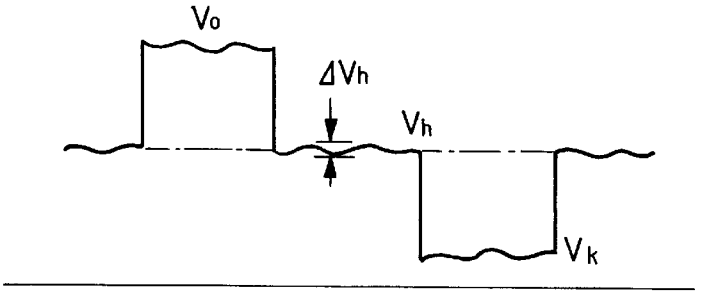
FIG. 7 is a view showing another example of the fluctuation of voltage in the background.

FIG. 7 is a view showing another example of the fluctuation of voltage in the background. Different from the voltage fluctuation $\Delta V_{hm}$ in the background illustrated in FIGS. 6A to 6C, a period of the fluctuation of $\Delta V_h$ is short. This fluctuation is caused by the partial fluctuation of the characteristic of the photoreceptor, the characteristic of the laser drive circuit, and the influence of noise. Due to the fluctuation, the generation of a fringe image and the occurrence of fog in the background are facilitated, and further image unevenness is caused by the fluctuation. In the same manner as explained in FIGS. 6A to 6C, it is preferable that $\Delta V_h$ is suppressed in a range of about ±10%.

Examples of usable photoreceptors of the present invention are: selenium photoconductor, amolphous silicon photoconductor, zinc oxide photoconductor, and organic photoconductor. It is preferable to use a single layer type positive polarity organic photoconductor, which is made as follows. For example, phthalocyanine pigment is used as an electric charge generating agent, and perylene pigment is preferably used as an electric charge generating agent. It is dispersed in resin such as polycarbonate together with an electric charge carrying material such as polyvinylcarbazole and hydrazone, and an additive such as sensitizer and deactivation agent. Then, it is coated by the thickness of 20 to 60 $\mu$m. Preferably, it is coated by the thickness of 30 to 50 $\mu$m. The thus obtained photoreceptor is characterized in that: charging can be uniformly conducted by means of corona charging; a quantity of generated ozone is small; resolution is high; and the manufacturing cost is low.

When this organic photoconductive photoreceptor is subjected to humidity saturation treatment after it has been heated and dried in the manufacturing process, it is possible to reduce a change in the characteristic caused by an environmental change when it is put into practical use. However, in general, the charging characteristic, sensitivity and residual voltage of the photoconductive photoreceptor are changed according to the frequency of use and the history of use.

Figure 8:
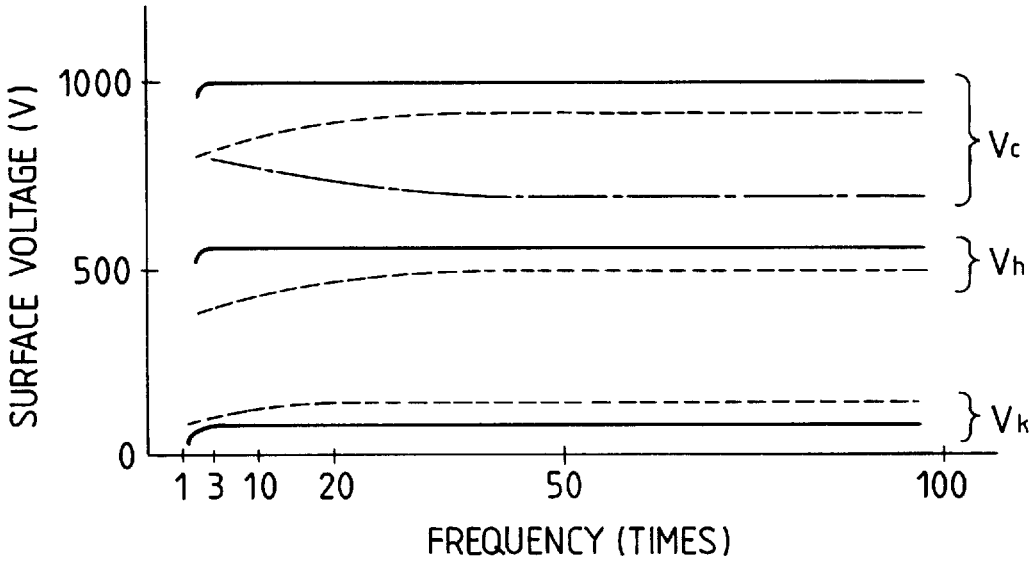
FIG. 8 is a graph showing an example of the charging characteristic of the single layer type positive polarity organic photoconductive photoreceptor.

FIG. 8 is a graph showing an example of the charging characteristic of the single layer type positive polarity organic photoconductive photoreceptor. On this graph, $V_0$, $V_h$ and $V_k$ are expressed by the functions of the frequency of repetition. In this case, measurement was conducted under the condition that the charging current and the quantity of exposure light were maintained constant.

On the graph, a solid line represents a new photoreceptor that was seldom used, a dotted line represents an old photoreceptor that was used to its life, and a one-dotted chain line represents a photoreceptor that was deteriorated. As can be seen on the graph, when the frequency of repetition reaches 3 to 50 times, operation can be stabilized. Accordingly, in this period of time in which operation tends to fluctuate, the normal printing operation is avoided, and this period of time is used as an initial operating process. That is, in this initial operating process, the surface voltage is measured, especially the voltage in the back portion is measured, and the fluctuation of voltage is measured, and further a quantity of adhering toner is measured. According to the results of measurement, it is judged whether or not a fringe is generated, and then adjustment is conducted so that a normal operation can be carried out.

For example, when $V_0$=1000±50 V, $V_{hn}$=550±50 V and $V_k$=100±20 V are set as prescribed values, in the case of a new photoreceptor illustrated by a solid line on the graph, in the initial operation process of 3 to 5 revolutions of the photoreceptor, it is judged whether or not at least the background $V_{hn}$ is within a range of the prescribed value, and it is adjusted so that the background $V_{hn}$ can be within the range of the prescribed value. After that, a normal printing operation is started. Concerning the photoreceptor represented by the dotted line, in the initial operating process of about 30 revolutions, it is judged whether or not at least the background $V_{hn}$ is in a range of the prescribed value, and it is adjusted so that the background $V_{hn}$ can be within the range of the prescribed value. After that, a normal printing operation is started.

Concerning the photoreceptor represented by the one-dotted chain line, in the initial operating process of about 50 revolutions of the photoreceptor, it is judged whether or not at least the background $V_{hn}$ is in a range of the prescribed value, and it is adjusted so that the background $V_{hn}$ can be within the range of the prescribed value. When it is judged that the background $V_{hn}$ is out of the range of the prescribed value even after the adjustment has been conducted, it is judged that the photoreceptor has served its time. It is preferable that the frequency of the initial operating process is determined by programming in such a manner that the history of the photoreceptor after replacement is estimated in accordance with the information obtained by the counter 47. However, the initial operating process may be repeatedly conducted until a transition of the voltage fluctuation becomes a value not higher than a predetermined value. A range of the appropriate prescribed voltage is changed in accordance with the characteristic of developer and allowable image quality as described later. Therefore, it is preferable that programming is conducted in such a manner that the prescribed value is changed in accordance with the history of use of the photoreceptor and the history of use of developer.

Figure 9:
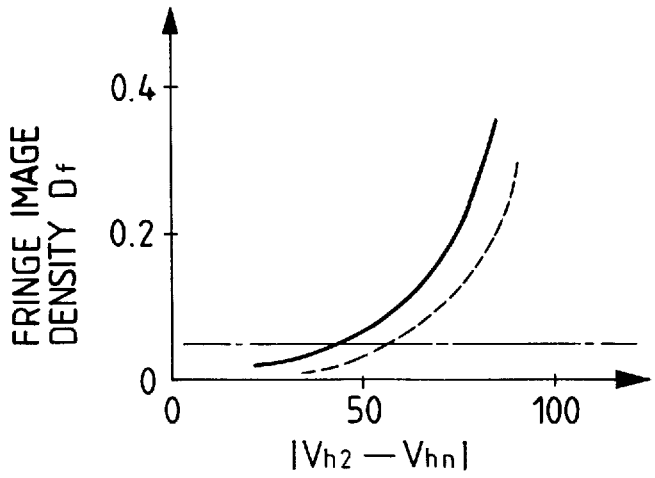
FIG. 9 is a characteristic diagram showing a relation between the background voltage and the fringe image density in the case where a two-component type magnetic developer is used.
Figure 10:
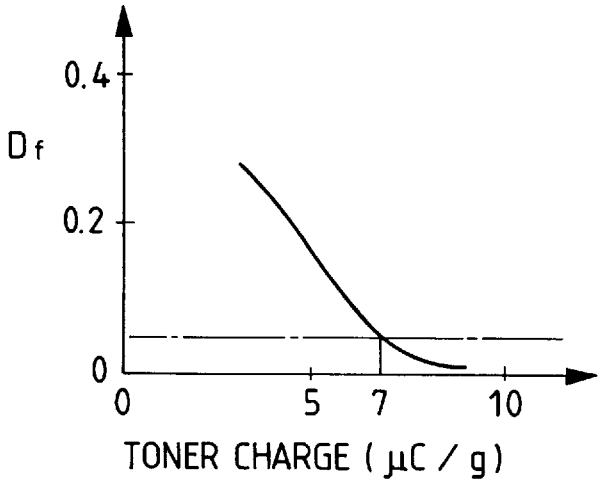
FIG. 10 is a characteristic diagram showing a relation between the toner electric charge and the fringe image density in the case where a two-component type magnetic developer is used.
Figure 11:
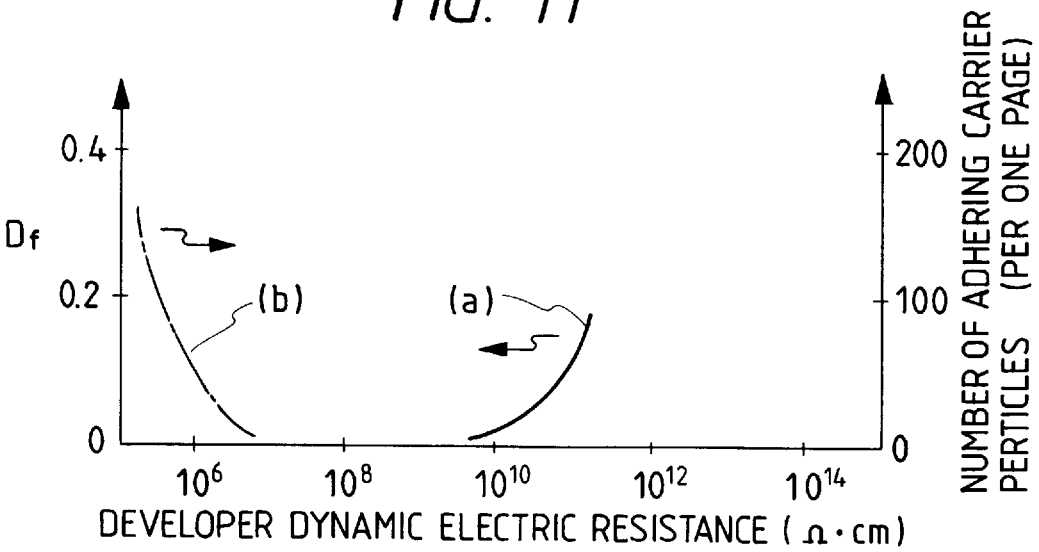
FIG. 11 is a characteristic diagram showing a relation between the dynamic electric resistance of a developer and the fringe image density and also showing a relation between the dynamic electric resistance of the developer and the number of adhering carrier particles in the case where a two-component type magnetic developer is used.

FIGS. 9 to 11 are characteristic diagrams of the fringe image density in the case where a two-component type magnetic developer is used, wherein the principal component of a two-component type magnetic developer is a magnetic carrier and nonmagnetic toner, or a magnetic carrier and magnetic toner. In this case, the fringe image density does not include a sheet reflecting density.

In this example, a magnetic carrier (magnetite, the average volumetric grain size of which is approximately 90 $\mu$m) and non-magnetic toner (the average volumetric grain size of which is approximately 10 $\mu$m) are used, and a gap (development gap) formed between the developing roller and the photoreceptor 2 is set at 1 mm.

FIG. 9 is a characteristic diagram of the fringe image density $D_f$ with respect to a change in the background voltage sin the case where the dynamic electric resistance of the developer is $3\cdot10^{10}$ Ω·cm, and the toner electric charge is approximately 7 $\mu$C/g. On the graph of FIG. 9, a solid line represents black, a dotted line represents red, and a one-dotted chain line represents an allowable limit. When an amount of fluctuation $|V_{h2}-V_{hn}|$ of the background voltage $V_{h2}$ from the prescribed voltage $V_{hn}$ is not less than 50 V, the occurrence of a fringe image is suddenly increased.

FIG. 10 is a characteristic diagram of the fringe image density $D_f$ with respect to an electric charge of black toner in the case where the dynamic electric resistance of the developer is $3\cdot10^{10}$ Ω·cm, and $V_{h2}-V_{hn}$=50 V. When the electric charge of the toner is small, the fringe image density is increased. When the dynamic electric resistance of the developer is lowered or the development gap is reduced, it is possible to allow an electric charge of toner of 7 $\mu$C/g. However, when the electric charge of toner is smaller than 7 $\mu$C/g, problems may be caused in such a manner that the occurrence of fog in the background is increased and toner is scattered. On the other hand, in order to obtain a practical recording image density, it is restricted in such a manner that the electric charge of toner is not more than 30 $\mu$C/g, and the electric charge of toner is preferably not more than 20 $\mu$C/g. Therefore, the electric charge of toner may be restricted in a range from 7 to 30 $\mu$C/g, and preferably the electric charge of toner may be restricted in a range from 7 to 20 $\mu$C/g.

In the case where the electric resistance of the toner and carrier is low, the electric charge of the toner of the two-component type magnetic developer is attenuated after it has been left over a long period of time. In order to solve the above problem, it is preferable to conduct the following operation. Before the initial operating process, according to the history of use of the printer, that is, according to the period of time in which the toner has been left and also according to the number of printed sheets of paper, only the developing unit is driven and the developer is agitated for 30 to 300 seconds so that the toner can be electrically charged again. When a phenomenon of fog in the background and a fringe image are generated although the surface voltage in the background and the fluctuation of voltage are in the range of the prescribed value, the electric charge of toner is low. Therefore, it is used as data to judge that the developer has served its time.

When the electric charge of toner is low and also when the occurrence of a fringe image and fog is marked, it is effective to replace the toner accommodated in the developing unit with a new one by a ratio of 10 to 50%. This operation is conducted as follows. A latent image, the area of which is large, is formed and developed, in which a large quantity of toner is consumed, and the quantity of consumed toner is counted by the counter 47. Using the thus obtained quantity of toner and the area of the image, the above operation is conducted. In this operation, it is preferable to raise a voltage to be impressed upon the cleaner so that the cleaning performance of the cleaner (CL2) 42 or cleaner (CL1) 30 can be enhanced. Even in the case of a one-component liquid type developer described later, it is possible to employ the above toner replacing operation.

Figure 20:
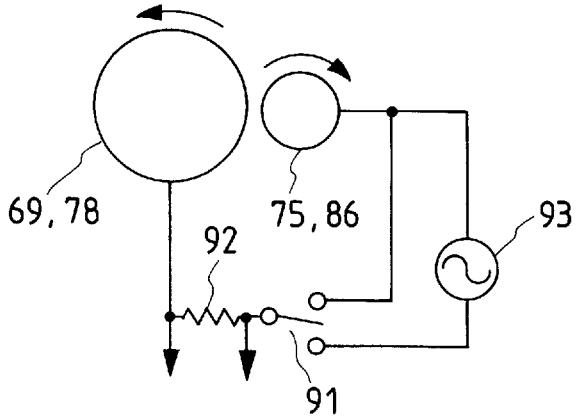
FIG. 20 is a circuit diagram to explain a method of measuring a dynamic electric resistance of a two-component magnetic developer and also a method of measuring an electric charge of toner.

Life of the developer is judged by the occurrence of a fringe image, the number of printed sheets of paper, the electric charge of toner, and the measured value of electric resistance of developer (described in FIG. 20). Even when the number of repetitions of the photoreceptor in the initial operation has reached the prescribed value, for example 50 times, when the electric charge of the toner and the electric resistance of the developer are out of the ranges of the prescribed values, it is judged that the toner has served its life.

FIG. 11 is a graph showing a relation (curve (a)) between the dynamic electric resistance of developer and the fringe image density under the condition that $V_{h2}-V_{hn}=50$ V and the electric charge of the toner is about 7 $\mu$C/g, and also showing a relation (curve (b)) between the dynamic electric resistance of the developer and the number of carrier particles adhering onto one page.

In this case, the adhering carrier is defined as particles of carrier contained in the developer that have adhered onto the photoreceptor by an electrostatic force, wherein the particles of the carrier must not essentially adhere onto the photoreceptor. In this case, the dynamic electric resistance of the developer is defined as a value measured in the following manner. Developer is made to magnetically adhere onto the developing roller by the thickness of 3 to 4 mm. Developer provided on the developing roller in this manner is made to pass in a gap of 0.8 mm formed by a restricting plate at the circumferential speed of 30 cm/s. Voltage of 100 V is impressed upon an electrode opposed to the magnetic pole forming a gap of 1 mm. In the above condition, the dynamic electric resistance of the developer is measured.

As can be seen on the graph, according to the curves (a) and (b), the appropriate dynamic electric resistance of the developer is $10^7$ to $10^{10}$ Ω·cm. A value of dynamic electric resistance of the developer at which the generation of a fringe image can be suppressed is changed by a developing gap. According to the experiment, the following were found. When the gap was 2 mm, the dynamic electric resistance of the developer was not higher than $10^8$ Ω·cm, and when the gap was 0.3 mm, the dynamic electric resistance of the developer was not higher than $10^{11}$ Ω·cm. However, the following were also found. When the gap was 2 mm, the formed image was affected by an increase in the electric resistance in accordance with the use of the developer, so that the image density was lowered quickly. When the gap was 0.3 mm, it was difficult to convey the developer at high speed.

Accordingly, in order to suppress the generation of a fringe image and obtain an image of high density over a long period of the time, it is appropriate to maintain the dynamic electric resistance of developer at $10^7$ to $10^{11}$ Ω·cm and to set the gap at 0.3 to 2 mm. It is preferable to set the gap at 0.5 to 1.5 mm. As described before, concerning two-component type magnetic developer, the average volumetric grain size of toner is 3 to 12 $\mu$m, and it is preferable that the average volumetric grain size of the toner is 6 to 9 $\mu$m. The average volumetric grain size of the carrier is 50 to 120 $\mu$m, and it is preferable that the average volumetric grain size of the carrier is 60 to 100 $\mu$m. Examples of usable materials of the carrier are: magnetite, ferrite iron, and resin containing a magnetic body. Concerning the toner, a non-magnetic toner may be used, and the magnetic toner may be used depending upon the color.

Figure 12:
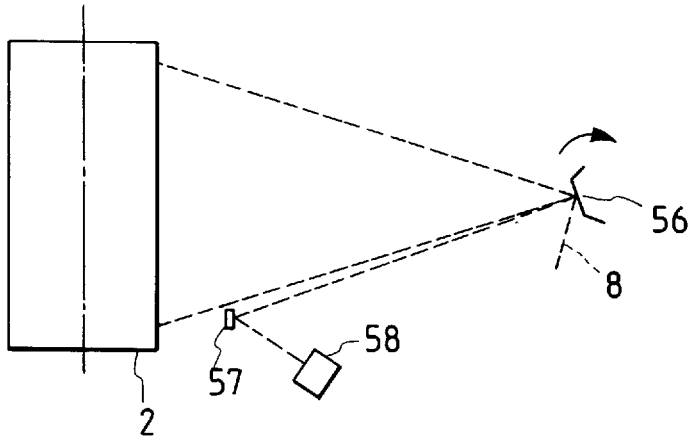
FIG. 12 is a schematic illustration showing a state in which optical scanning is conducted on the photoreceptor by laser beams.

FIG. 12 is a schematic illustration showing a state in which optical scanning is conducted on the photoreceptor 2 by laser beams 8. Laser beams 8 conduct scanning when the polygonal mirror 56 is rotated. At the end portion that is a start point of scanning, laser beams 8 are introduced to the beam detector 58 by the mirror 57, and the thus obtained detection signal is used to determine the time at which a signal to be recorded (recording signal) is sent out.

Figure 13:
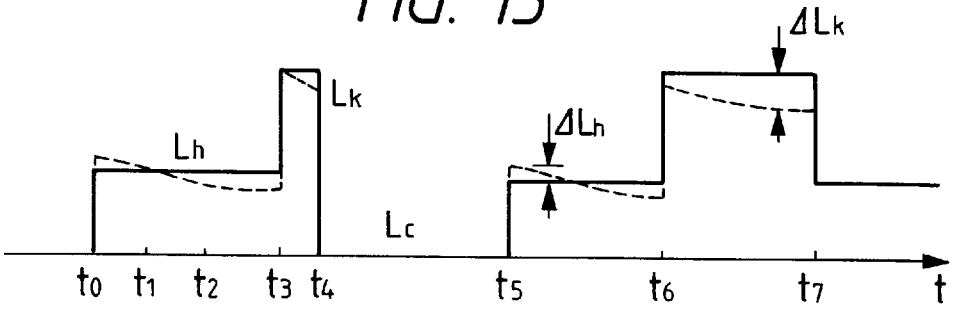
FIG. 13 is a schematic illustration showing a change in the quantity of light of a recording signal at the time t in the optical scanning process.

FIG. 13 is a view showing a change in the quantity of light of a recording signal at the time t in the optical scanning process. In the view, $t_0$ is time to start emitting light, $t_1$ is the time at which light is detected by the beam detector 58, and $t_2$ is the time at which a recording signal starts. In the view, ($t_2$ to $t_3$), ($t_5$ to $t_6$) and t7 are the background portions, ($t_3$ to $t_4$) and ($t_6$ to $t_7$) are black portions, and ($t_4$ to $t_5$) is a red portion. In the view, a solid line represents a desirable change in the quantity of light, and a dotted line represents a conventional example of the change in the quantity of light in the case of using a semiconductor laser, especially in the case of using a laser from which laser beams of short wavelength of not more than 700 nm are emitted. That is, as illustrated by a dotted line in the view, in the case of a semiconductor laser from which laser beams of short wavelength are emitted, a quantity of light is reduced by the heat generated by the laser itself in accordance with the emission of light as illustrated by the dotted line.

On the other hand, concerning the laser from which laser beams of short wavelength are emitted, various types of photoreceptors can be applied to it, because it is easy to adjust the optical system, and further recording of high resolution can be easily accomplished. For the above reasons, it is preferable to use the laser from which laser beams of short wavelength are emitted. However, in the conventional laser beam scanning system used for binary recording, there is provided no portion in which a quantity of light is intermediate. Accordingly, even if a quantity of light emitted from the laser is adjusted to a value corresponding to the period of the to $t_0$ $t_1$, no problems are caused when the saturation characteristics of electrostatic latent image formation and development are utilized. However, it is preferable that a change $\Delta L_h$ in the quantity of light in the background in the three-level recording applied to the present invention is made to be equal to or lower than an allowable range of the fluctuation of voltage in the background described before. Of course, it is preferable that a change $\Delta L_k$ in the quantity of light in the black portion is also small.

A change in the quantity of light is caused by the heat generated in the laser. In addition to that, a change in the quantity of light is caused by a defective waveform of the drive current (signal current) illustrated in FIG. 14. It is preferable that a change in the quantity of light caused by a defective waveform of the drive current is accommodated in the same range. In order to prevent a change in the quantity of light caused by generated heat, in the control circuit illustrated in FIG. 15, it is effective to suppress the fluctuation of a signal current by using a high speed transistor and IC, and further it is effective to shorten the length of wiring and reduce the floating capacity.

Figure 15:
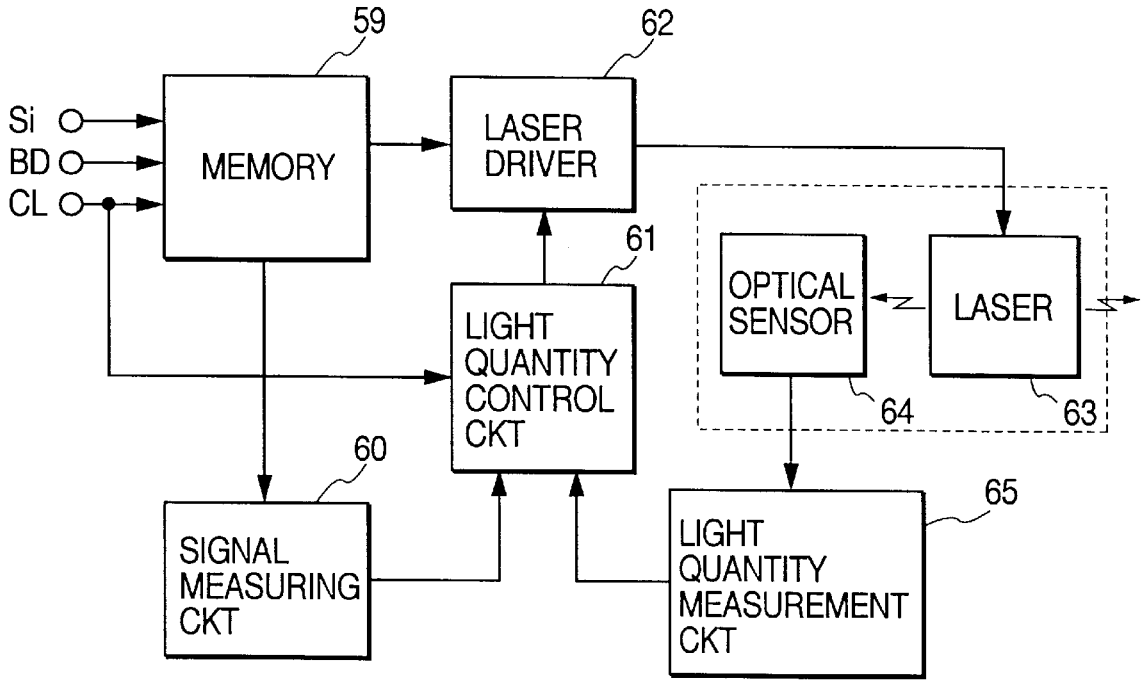
FIG. 15 is a block diagram showing a preferable control circuit to control a quantity of light emitted from the laser.

FIG. 15 is a block diagram showing a preferable embodiment to control a quantity of light emitted from a laser. A recording signal $S_i$ of two colors-sent from the outside of the block diagram is temporarily stored in the memory 59 having a capacity corresponding to at least one scanning line. Then, the recording signal $S_i$ is sent to the laser driver 62 in synchronization with the beam detector signal BD and clock signal CL, so that the laser 63 can be driven. On the other hand, the signal is also sent to the signal measuring circuit 60, and the red portion, the black portion and the background are discriminated, and their running lengths are measured, and the result of measurement is given to the light quantity control circuit 61.

The above operation is conducted for the following reasons. Although a quantity of emitted light is controlled while it is being measured by the optical sensor 64, it is difficult to conduct controlling at a point of change of a signal because there is a time lag. With respect to a fringe image, this point of change of a signal is important. In order to improve the above problem, the aforementioned operation is conducted. For example, as illustrated in FIG. 13, after the red portion (a quantity of light is zero in the red portion) continues, the background comes ($t_1$). Since a quantity of emitted light is increased in this case, a quantity of light in the portion $t_1$ is set so as to suppress an increase of the quantity of emitted light. In the case where the black portion comes after the background continues ($t_6$), since a quantity of emitted light is decreased, a quantity of light is set so that a quantity of light in the portion $t_6$ can be increased.

Figure 14:
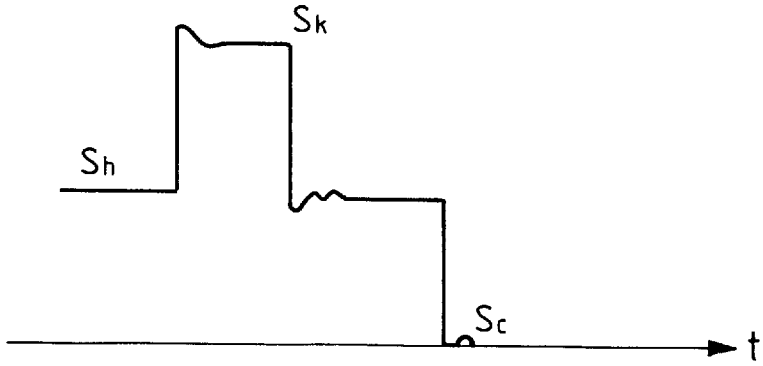
FIG. 14 is a schematic illustration showing a deformed waveform of the drive current.

The light quantity control circuit 61 determines an amount of control in accordance with signals sent from the signal discrimination circuit 60 and the light quantity measurement circuit 65. Then light quantity control circuit 61 controls the laser driver 62 in synchronization with the clock signal CL. In order to control a quantity of light at high speed by the above arrangement while the occurrence of disadvantages described in FIGS. 13 and 14 is prevented, it is preferable that the laser 63 and the optical sensor 64 are integrally incorporated to each other and the thus incorporated body is mounted at high density on the same circuit board as that of other components. It is preferable to use a pin-joint type diode, which is capable of detecting beams of light at high speed, for the optical sensor 64.

Figure 16:
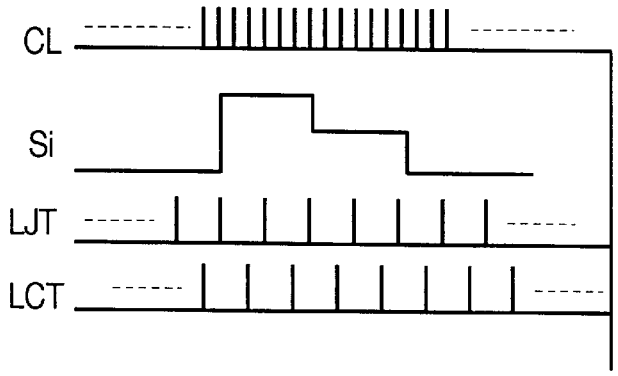
FIG. 16 is a timing chart of each signal shown in FIG. 15.

FIG. 16 is a diagram showing relations among the clock signal CL, two color recording signal $S_i$, light quantity measurement time LJT, and light quantity control time LCT in FIG. 15. It is preferable that an interval of time between LJT and LCT corresponds to 1 to 10 dots. It is also preferable that a delay of time of LCT is 1 to 5 dots. In this way, it is possible to realize an exposure conducted by a semiconductor laser, the fluctuation of light quantity of which is small.

FIGS. 17A to 17D are schematic illustrations showing a recording pattern used for the initial operation suitable for the present invention. When the above pattern is used, it possible to extremely reduce a quantity of toner used in the process of initial operation.

FIG. 17A is a view showing a pattern 48 of the red portion, and an electric charge latent image. It is suitable that dimensions of the pattern are 20 mm to 50 mm square. After the above latent image has been formed, the red developing roller is not operated but only the black developing roller is operated in the developing process. When the condition of generation of a fringe image is satisfied at this time, a black fringe image is developed only in the periphery of this pattern.

FIG. 17B is a view showing a pattern 49 of the black portion, and an electric charge latent image. After a latent image has been formed in the same manner as that of FIG. 17(*a*), the black developing roller is not operated but only the red developing roller is operated in the developing process. When the condition of generation of a fringe image is satisfied at this time, a red fringe image is developed only in the periphery of this pattern. Accordingly, these two latent images are successively developed, and the surface voltage $V_{h1}$ in the background is measured and the developed fringe image is detected by the toner sensor 37 or 371. According to the result of measurement and detection, it is possible to judge the circumstances of image formation, so that adjustment can be appropriately carried out. In this case, very small quantities of red and black toner are used.

FIGS. 17C and 17D are views showing examples in which pseudo patterns are illustrated. In these views, these pseudo patterns and electric charge latent images are shown. FIG. 17C is a view used for detection of a red fringe image, and FIG. 17D is a view used for detection of a black fringe image. It is preferable to arrange several rectangular latent images, the length of which is 20 to 50 mm. In the case shown in FIG. 17C, when the background voltage $V_{h1}$ becomes close to $V_{b1}$, which is a condition in which a red fringe image tends to be generated, the red toner image is developed in the $V_{hc}$ portion. On the contrary, in the case shown in FIG. 17D, when the background voltage $V_{h1}$ becomes close to $V_{b2}$, which is a condition in which a black fringe image tends to be generated, the black toner image is developed in the $V_{hk}$ portion. The developing operation shown in FIG. 17C and the developing operation shown in FIG. 17D can be simultaneously conducted. Accordingly, even if the above pseudo patterns are used, the generation of a fringe image can be judged and adjusted in the same manner as that illustrated in FIGS. 17A and 17B.

It is preferable to conduct the developing operation of both red and black. However, when one of them is in a condition in which a fringe image tends to be generated, only the developing operation of one of red and black may be conducted. It is also possible to measure a fringe image of two colors by the toner sensor and adjust a charging voltage and an amount of exposure so that a fringe image can not be generated. In this case, it is possible to omit the measurement of voltage in the background. The method of detecting and judging a fringe image explained in FIGS. 17A to 17D can be adopted to not only the detection of a fringe image but also the detection and control of fog caused in the background. The method of detecting and judging a fringe image explained in FIGS. 17A to 17D can be also adopted to a manual adjusting method in which adjustment is conducted while the fringe image is actually recorded on a sheet of paper and adjustment is conducted in accordance with the recorded image.

FIG. 18 is a view showing an example of the procedure of the initial operation process according to the present invention. In FIG. 18, reference numeral (1) represents a initial setting operation, reference numeral (2) represents a measurement of surface electric potential of the photoreceptor 2 conducted by the electric potential sensor 10, reference numeral (3) represents an adjustment of $V_0$ of the grid power supply 6 conducted by the controller 11, reference numeral (4) represents an adjustment of $V_h$ and $L_h$ of the laser beam source 7 conducted by the controller 11, reference numeral (5) represents a judgment of $\Delta V_h$ and $\Delta V_{hm}$ illustrated in FIGS. 6 and 7, reference numeral (6) represents a measurement of the fringe image density $D_f$ (toner image) illustrated in FIG. 9, reference numeral (7) represents a measurement of toner electric charge, fringe image density $D_f$ and the number of adhering carrier particles, reference numeral (8) represents a judgment of image quality such as generation of a fringe image, reference numeral (9) represents a judgment of a photoreceptor and developer, and reference numeral (10) represents a start of recording (image formation).

It is preferable to start an image forming operation via the above series of processes. In the judgment (8) of image quality, the generation of a fringe image is mainly judged, however, it is preferable to judge fog and image density in parallel with the judgment of occurrence of a fringe image. Except for the above series of processes, as explained before referring to various examples, the following methods may be adopted. Examples of usable methods are: a method in which the items (6) to (9) or the items (2) to (5) are omitted, a method in which the items (7) and (9) are omitted, a method in which recording is conducted on a sheet of paper in the middle of image formation for the purpose of confirmation, a method of adding a process in which toner is electrically charged, before the initial setting (1), and a method of adding a process in which a portion of toner is replaced with new one. In the case where the toner image measurement (6) or the developer measurement (7) is not conducted, the initial operating process may be carried out without conducting a developing process or operating a developing unit.

Figure 19:
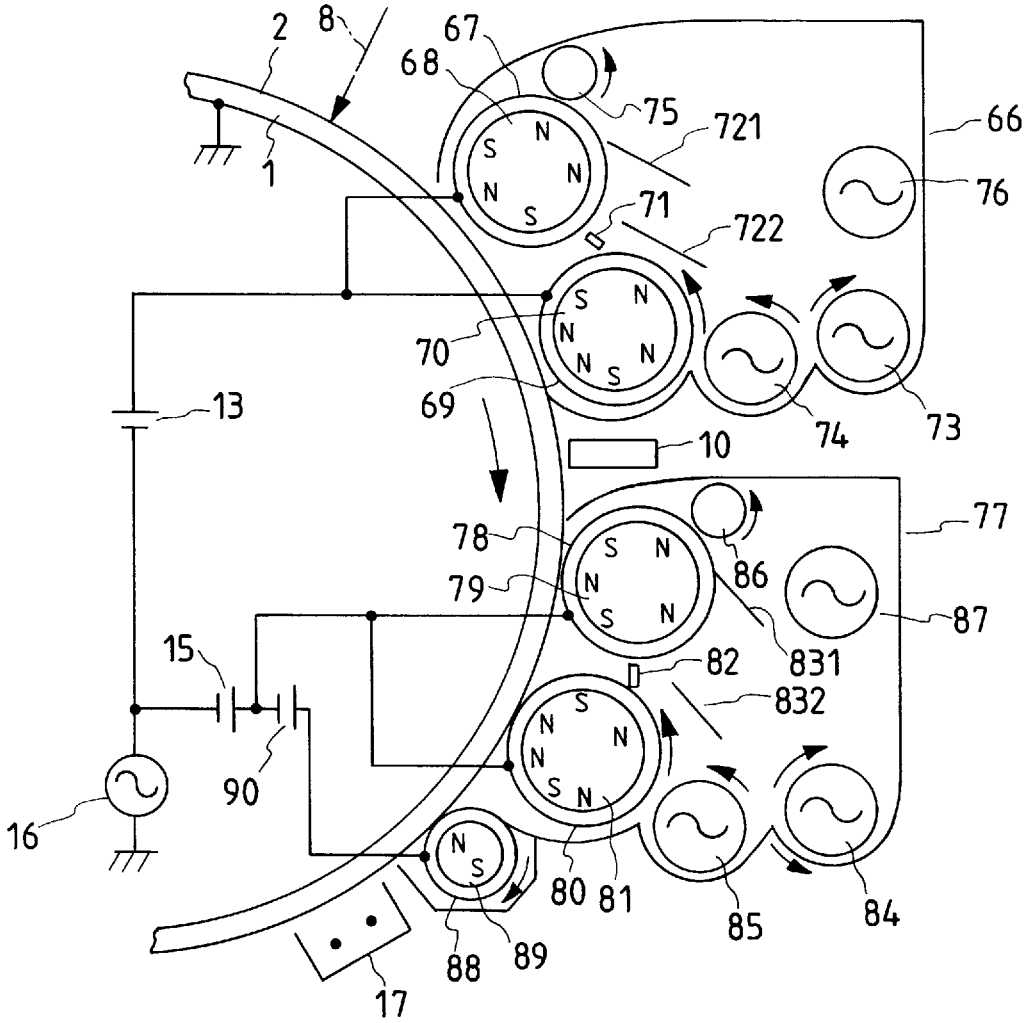
FIG. 19 is an arrangement view showing an outline of the image forming section of the color image forming apparatus of another embodiment of the present invention in which a two-component developer is used as a developing system to develop three electric latent images.

FIG. 19 is an arrangement view showing an outline of the developing section of the color image forming apparatus in which a two-component developer is used as a developing system to develop three electric latent images. This image forming apparatus includes a means for measuring an electric charge of the toner and a means for measuring a dynamic electric resistance of developer. These means are arranged in the developing unit. By the above means, it is possible to judge a state of the developer in the initial operating process and normal printing process.

Three electric charge latent images formed on the photoreceptor 2 are developed by the color developing unit 66 and the black developing unit 77. The color developing unit 66 includes two developing rollers. One is a color developing 10 roller 67 into which the stationary magnet 68 is incorporated, and the other is a color developing roller 69 into which the stationary magnet 70 is incorporated. The developer is attracted by the magnetic forces of the developing rollers 67, 69. The developing rollers 67, 69 are rotated in the direction of the arrow. Therefore, the developer is conveyed by developing rollers 67, 69 while the thickness of a developer layer is restricted by the restricting plate 71. When the developing roller comes into contact with the photoreceptor 2, a color electric charge latent image on the photoreceptor 2 can be developed.

The developing roller 67 is rotated in the direction reverse to that of the photoreceptor 2, and the developing roller 69 is rotated in the same direction as that of the photoreceptor 2. Concerning the developing magnetic poles of the magnet 70 opposed to the photoreceptor 2, as illustrated in FIG. 19, the magnetic poles of the same polarity are arranged in conjunction with each other. Due to the foregoing arrangement, it is possible to enhance the developing efficiency, and it is also possible to use a roller of small diameter or reduce the rotational speed. Due to the foregoing arrangement, no phenomenon occurs in which the developing direction is emphasized as explained in FIG. 6C. As described before, the developing gap is set at 0.5 to 1.5 mm. Surplus developer restricted by the restricting plate 71 and the developer, the toner of which has been consumed during the rotation of the color developing roller 67, are returned to the developer agitating section having screw augers 73, 74 by the scrapers 721, 722, so that the developer is mixed with toner that has been fed by the toner feeder 76. The electrode 75 is provided for measuring a dynamic electric resistance of the developer and an electric charge of the toner.

The black developing unit 77 has the same arrangement as that of the color developing unit 66. The black developing unit 77 includes: a black developing roller 78, magnets 79, 80, magnet 81, restricting plate 82, scrapers 831, 832, screw augers 84, 85, electrode 86 and toner feeder 87. The operation of the black developing unit 77 is the same as that of the color developing unit 66. In this black developing unit 77, a ratio of the restricting plate gap to the developing gap is preferably smaller than that of the color developing unit 66 by 10 to 20%, wherein the ratio of the restricting plate gap to the developing gap is usually 0.7 to 1.2 although the most appropriate value varies according to the developer, the magnetic pattern of the magnet and the position of the restricting plate.

The reason why the ratio of the restricting plate gap to the developing gap is determined as described above is that the developer is made to softly come into contact with the photoreceptor 2 so as to prevent the color toner, which has already been developed, from being scraped off. Especially, the foregoing may be adopted to the black developing roller 78, the rotational direction of which is reverse to the moving direction of the photoreceptor 2. In the black developing unit 77, there is provided a carrier catch roller 88 to remove carrier that has adhered onto the photoreceptor 2. Since the color developer carrier can be removed by the black developing roller, the carrier catch roller 88 mainly removes the black developer carrier. In this case, the carrier can be removed by a magnetic force generated by the magnet 89 incorporated in the carrier catch roller 88. Also, the carrier can be removed by an electric force generated by the bias power supply ($V_{b2}$) 15, bias power supply ($V_{bc}$) 90, and AC power supply (AC1) 16. A gap between the carrier catch roller 88 and the photoreceptor 2 is set at 0.5 to 1 mm. Voltage to be impressed upon the carrier catch roller 88 is preferably set at a high value as long as the developed color toner is not removed from the photoreceptor 2. Specifically, it is appropriate that the DC component is determined to be $V_{b2}$ to $V_0$, and the AC component is determined so that the effective voltage can be 200 to 500 V.

FIG. 20 is a view showing an exemplary method of measuring a dynamic electric resistance of a two-component magnetic developer and also a method of a measuring an electric charge of toner. This method is applied to the embodiment illustrated in FIG. 19.

There are provided electrodes 75 and 86 which act on the developer magnetically attracted to and carried by the developing rollers 69, 78. In this case, the electrodes 75 and 86 are opposed to the magnetic poles of the magnets accommodated in the developing rollers 69, 78, wherein the substantially same gaps as the developing gap between the developing roller and the photoreceptor 2 are formed between the electrode 75 and the developing roller 69 and also between the electrode 86 and the developing roller 78. It is preferable that the electrodes 75, 86 are rotated at the circumferential speed 0.1 to 0.5 time as high as the circumferential speed of the developing rollers 69, 78, however, the electrodes 75, 86 may be stationary rollers. When the dynamic electric resistance of developer is measured, the switch 91 is turned on so that voltage can be impressed by the AC power supply 93, and voltage generated by the resistor 92 is measured and converted into the dynamic electric resistance of the developer. Measurement may be also conducted by a DC voltage. In this case, the polarity may be determined so that toner can not adhere to the electrode. It is preferable to use AC voltage because toner is difficult to adhere to both the electrodes and the developing rollers 69, 78 when AC voltage is impressed.

It is appropriate that the frequency of an alternating current to be impressed is 50 to 1000 Hz and the effective voltage is 50 to 200 V. The toner electric charge is measured in such a manner that the developing rollers 69, 78 are connected to the electrodes via the resistor 92 and voltage generated in the resistor 92 is measured and converted into the toner electric charge. An electric current flowing in the measurement circuit is substantially proportional to the electric charge of the carrier. Therefore, it is possible to indirectly measure the electric charge of the toner. By the above measuring means, the dynamic electric resistance and the electric charge of the toner are measured in the initial operating process, the printing process and the developing unit operating process to be conducted before the initial operating process. By the result of the above measurement, it is possible to judge whether or not it is in a range in which no fringe images occur, whether or not it is in a range in which a sufficiently high image density can be obtained, whether or not it is in a range in which the occurrence of fog can be practically suppressed, and whether or not the developer has served its life.

It is preferable to conduct programming in such a manner that the predetermined values change in accordance with the history of the use of the developer. In any case, when the toner electric charge is determined in a range of ±20% with respect to the predetermined value and the dynamic electric resistance is determined in a range of ±50% with respect to the predetermined value, it is possible that an image of high quality can be provided without changing other conditions greatly. The above has been proved by a series of experiments made by the inventors. Accordingly, when the number of repetition reaches a predetermined value after the initial operating process has been carried out through a predetermined procedure, it can be judged that the toner has served its life.

In the arrangement illustrated in FIG. 19, the electrode is located at a position where the electrode comes into contact with the developer after it has been used for development. However, when measurement is conducted in the printing operation, the result of the measurement is affected by the density of toner before and after development. In order to avoid the influence of fluctuation of the density of toner, it is preferable that the measurement is conducted on the developer before development.

Figure 21:
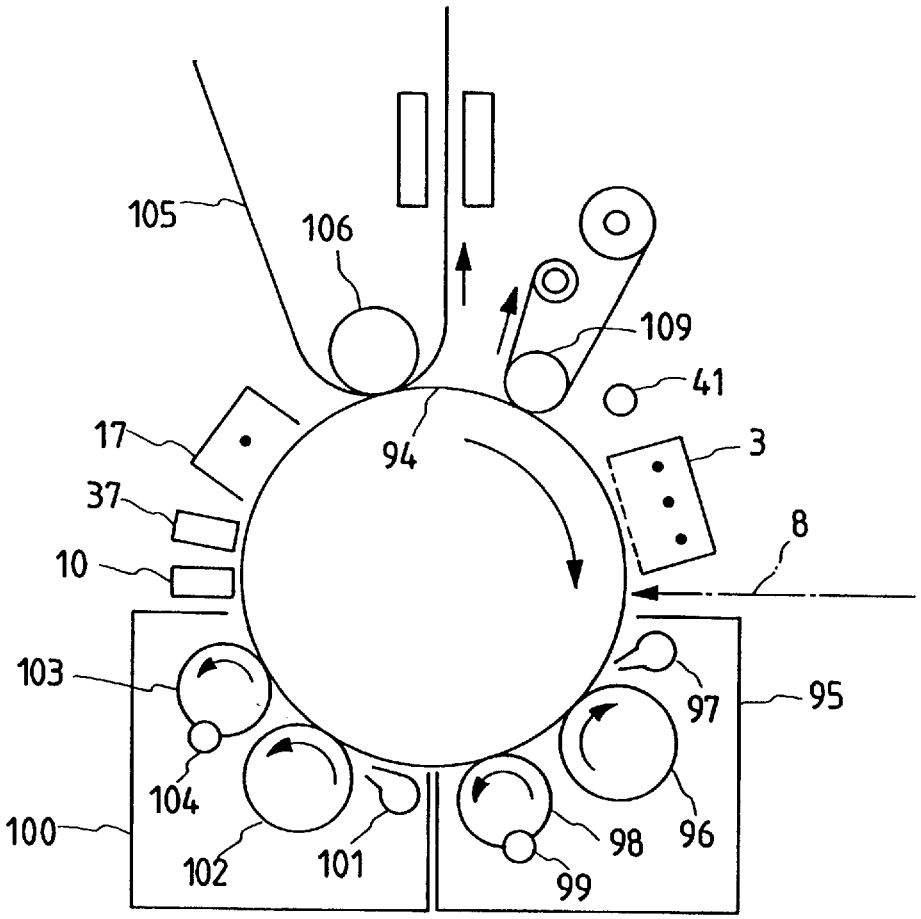
FIG. 21 is an arrangement view showing an outline of the image forming section of the image forming apparatus of still another embodiment of the present invention into which an amorphous silicon photoreceptor drum is incorporated.

FIG. 21 is an arrangement view showing an outline of the image forming section of the image forming apparatus into which an amorphous silicon (a—Si) photoreceptor drum is incorporated.

As explained before referring to FIGS. 1 and 19, when the surface voltage is measured and controlled, it is possible to maintain the background voltage in a predetermined range. However, in the case of a photoreceptor made of amorphous silicon (a—Si), the resolution deteriorates in accordance with the use of the photoreceptor. Therefore, when the photoreceptor made of amorphous silicon (a—Si) is used for multi-value recording, it is difficult to stabilize the background voltage. The reason why the background voltage is not stabilized is that the photoreceptor made of amorphous silicon (a—Si) tends to be attacked by ozone and nitride oxide which are products of corona discharge generated by the charger 17.

In order to prevent the attack upon the photoreceptor made of amorphous silicon (a—Si), after the photoreceptor has been subjected to a CVD method so as to form a film on its surface, the photoreceptor is impregnated or coated with insulating oil (silicon oil or mineral oil) or wax, or alternatively the photoreceptor is subjected to surface polishing, or a thin oil film is formed on the surface of the photoreceptor in the image forming process. Alternatively, powder toner to which an oil component or a wax component is externally added is used while the above component is being fed onto the photoreceptor layer. Alternatively, an insulating liquid developer is used. Due to the foregoing, products of corona discharge can be prevented from adhering onto the photoreceptor surface or products of corona discharge can be removed from the photoreceptor surface. When the above countermeasures are taken, the aforementioned problems can be solved. When the photoreceptor made of amorphous silicon (a—Si) is used by the above methods and the aforementioned initial operating process is applied, it is possible to form a color image of high quality.

When liquid developer is used, in order to provide a sufficiently high effect and further in order to maintain the environment in safety, it is necessary to provide a new means. FIG. 21 is an arrangement view showing the embodiment. The photoreceptor drum 94 made of amorphous silicon (a—Si) is electrically charged by the charger 3, and then three electric charge latent images are formed by the laser beams 8. Successively, the latent image is developed by the color developing unit 95 and the black developing unit 100, so that a toner image of two colors can be formed. In the color developing unit 95, there is provided a conductive developing roller 96 upon which a bias voltage is impressed, and developer is fed onto the developing roller 96 from the nozzle 97 so as to develop the image. After the completion of development, redundant developer is removed by the sponge-like squeeze roller 98.

A gap formed between the photoreceptor drum 94 and the developing roller 96 is set at 0.1 to 0.5 mm, and a gap formed between the photoreceptor drum 94 and the squeeze roller 98 is set at 0 to 0.5 mm. In this case, the squeeze bar 99 is used for squeezing developer from the squeeze roller 98.

In the same manner as described above, the black developing unit 100 includes: a nozzle 101, developing roller 102, squeeze roller 103 and squeeze bar 104. Since the developing roller 102 is rotated in the same direction as that of the photoreceptor drum 94, color toner that has already adhered onto the photoreceptor 94 is difficult to be scraped off by the developing roller 102.

The electric potential sensor 10 and the toner sensor 37 are arranged after the color and the black developing unit. When the electric potential sensor 10 is arranged at this position, in the case of measuring the electric potential in the background, it is necessary to correct the attenuation of voltage in the black developing unit region. However, the above arrangement is advantageous when the voltage of a developed toner image is measured so as to find the electric charge of toner.

After the electric charging polarities of the black and the color toner image have been adjusted by the charger 17, both toner images are transferred onto a continuous sheet of paper 105 by the action of a transfer electric field generated by the transfer roller 106. Residual toner and liquid developer are wiped out from the surface of the photoreceptor drum 94 by at least a pressure roller 109, and a thin film of oil is formed on the surface of the photoreceptor drum 94 at the same time. The residual electric charge is removed from the surface of the photoreceptor drum 94 by the discharging lamp 41. Then the apparatus starts the successive image forming cycle.

In the above arrangement, in order to solve an environmental problem caused by the evaporation of insulating oil contained in the developer, and in order to avoid a problem of safety caused by the ignition of insulating oil, and further in order to avoid various problems caused by corona products, it is necessary that the ignition point of insulating oil is not lower than 60° C., and it is preferable that the ignition point of insulating oil is in a range from 65° C. to 85° C. When the ignition point is lower than 60° C., remarkable problems may be caused by the evaporation of insulating oil. When the ignition point exceeds 85° C., the developing speed is lowered, and it becomes difficult to form a thin film of oil uniformly before charging.

As described above, in the image forming apparatus according to the present invention, during the initial operating process in which the photoreceptor drum is rotated by a predetermined number of revolutions, the fluctuation of voltage in the background is measured by the electric potential sensor 10, and a fringe image is detected by the toner sensor 37. Due to the foregoing, it can be judged whether or not an image of multi-color can be normally printed.

Figure 22:
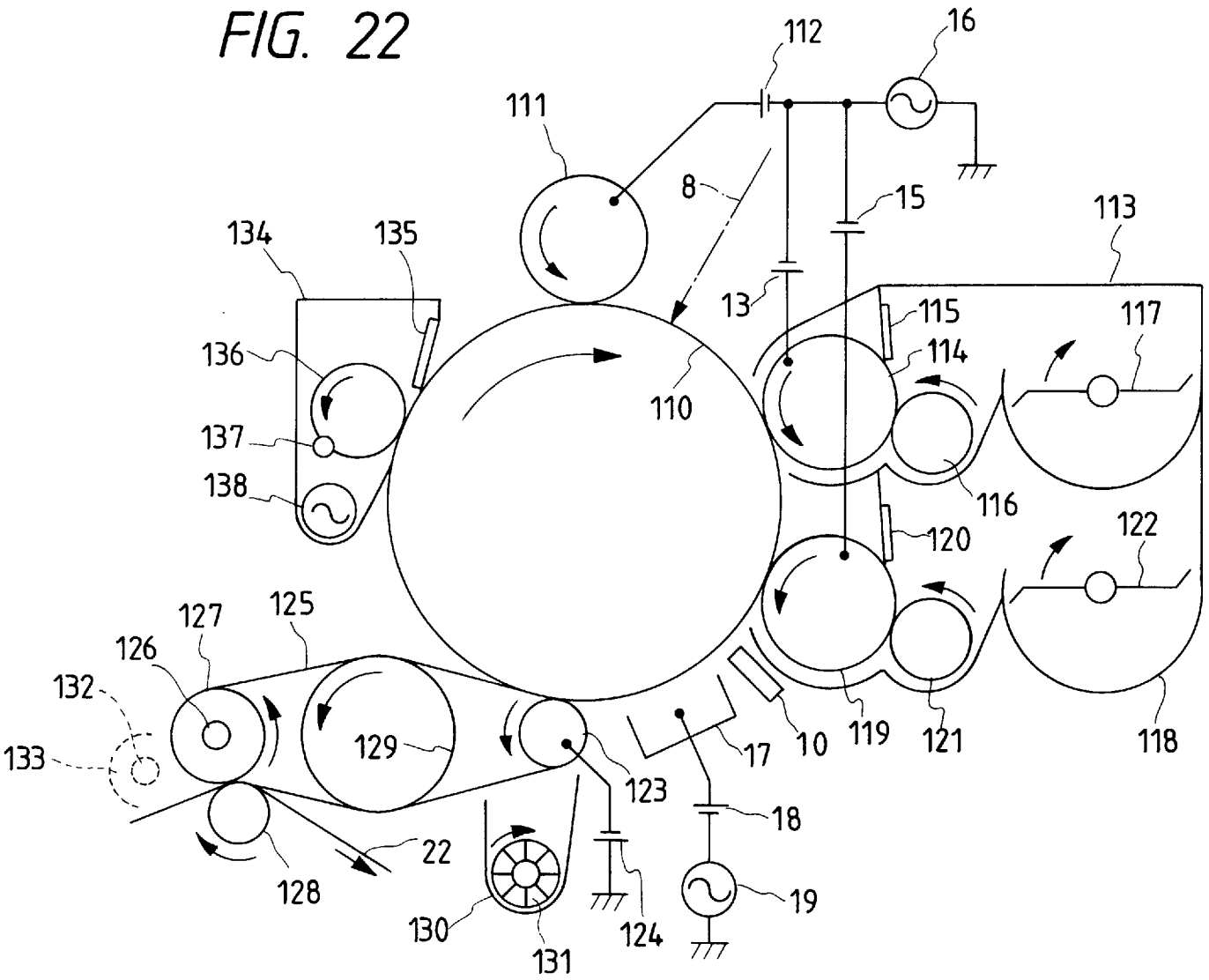
FIG. 22 is an arrangement view showing an outline of the image forming section of the image forming apparatus of still another embodiment of the present invention in which one-component type nonmagnetic developer is used.

FIG. 22 is an arrangement view showing an outline of the image forming section of the image forming apparatus in which one-component type nonmagnetic developer is used.

When the photoreceptor drum 110 is rotated, it is uniformly charged by the charging roller 111 to a voltage fed from the high voltage power supply 112 and AC power supply 16. Next, three electric charge latent images are formed on the photoreceptor drum 110 by the laser beams 8. The thus formed latent image is developed into a two color toner image by the color developing unit 113 and the black developing unit 118. Since the developing units 113 and 118 are integrated with each other, it is possible to make them compact at low cost. In the color developing unit 113, development is conducted as follows. One-component nonmagnetic toner is fed to the developing roller 114 by the reset and feed roller 116 and toner feed fin 117. The thus fed one-component nonmagnetic toner is electrically charged by the charging blade 115. The developing roller 114 is made to come into contact with the photoreceptor drum 110 or made to be close to the photoreceptor drum 110, and the latent image is developed while voltage sent from the bias power supply ($V_{b1}$) 13 and AC power supply (AC1) 16 is impressed upon the developing roller 114.

In order to prevent the generation of a fringe image, a gap formed between the photoreceptor drum 110 and the developing roller 114 is set at a value not more than 0.2 mm, and it is preferable that the developing roller 114 is contacted with the photoreceptor drum 110. The reset and feed roller 116 has a reset function of removing toner adhering to the roller. The electric charge of color toner, by which the first development is conducted, is 5 to 50 $\mu$C/g. It is preferable that the electric charge of color toner is 10 to 30 $\mu$C/g. When the electric charge of color toner is maintained at 10 to 30 $\mu$C/g, it is possible to accomplish both the suppression of a fringe image and the formation of a high image density, and further toner is seldom scraped off by the second developing roller 119.

In the same manner as that of the color developing unit 113, the black developing unit 118 includes: a black developing roller 119, charging blade 120, reset and feed roller 121, and toner feed fin 122. The latent image is developed while voltage sent from the bias power supply ($V_{b2}$) 15 and AC power supply (AC1) 16 is impressed upon the developing roller 119. The color developing roller 114 and the black developing roller 119 are rotated in the direction of the arrow illustrated in the drawing. It is preferable that the circumferential speeds of these rollers are 0.7 to 2.0 times as high as that of the photoreceptor drum 110. Especially, the circumferential speed of the black developing roller 119 is 0.8 to 1.2 times as high as that of the photoreceptor drum 110 so that the formed color toner image can not be scraped off.

A gap formed between the photoreceptor drum 110 and the black developing roller 119 is preferably not more than 0.2 mm from the viewpoint of preventing the toner image from being scraped off, or alternatively the black developing roller 119 is lightly contacted with the photoreceptor drum 110. The electric charge of black toner may be approximately the same as that of color toner.

In the same manner as that illustrated in FIG. 21, the electric potential sensor 10 is arranged at the rear of both developing units and measures the charged voltage of the photoreceptor drum and the electric potential of the adhering toner. Polarities of the developed color toner image and the black toner image are adjusted by the charger (C2) 17 with a positive power supply of high voltage (H2) 18 and an AC power supply (AC2) 19. After that, the color toner image and the black toner image are transferred onto the transfer belt 125 by the transfer roller 123 upon which voltage sent from the high voltage power supply 124 is impressed. The transfer belt 125 and the transferred toner are given heat by the heat exchange roller 129 and the heat roller 127, so that they are put into a semi-melted condition.

The heat roller 127 is heated to a predetermined temperature by the heater 126 which is incorporated into the heat roller 127. When the thus heated toner is made to come into contact with a sheet of recording paper 22 and pressed by the backup roller 128, the toner can be transferred and fixed simultaneously onto the sheet of recording paper 22. It is preferable that the toner surface and the sheet surface are heated by the heater 132 before the toner is contacted with and pressed against the sheet of recording paper. Due to the foregoing, fixation can be facilitated. The reflecting plate 133 is provided for the purpose of enhancing the thermal efficiency of the heater 132. Temperature of the heat roller 127 is controlled in accordance with the temperature of the heat exchange roller 129 or the temperature of the transfer belt 125 before it reaches the heat roller 127.

According to the above fixing system, it is possible to lower the temperatures of the heat roller 127 and the sheet of recording paper compared with the conventional fixing system composed of the heat roller and the backup roller. Accordingly, an amount of deformation of the sheet of recording paper can be decreased, and further electric consumption can be suppressed. Further, this fixing system is characterized in that: it is possible to accomplish 100% transfer; and toner of small grain size, the grain size of which is 3 to 6 μm, can be used, and toner, the pigment component of which is 10 to 30 wt %, can be used. According to the conventional fixing system, it is difficult to use such toner. When the fixing system of the present invention is adopted, it is possible to record an image of high density when only a small quantity of toner is used.

Successively, the transfer belt 125 is cooled by the heat exchange roller 129 and a cooling wind sent from the fan 131 of the cooling unit 130. Then the apparatus is put into the next transfer process. In this system, heat can be recovered by the heat exchange roller 129, so that the thermal efficiency of the fixing unit can be enhanced and energy can be saved.

The heat exchange roller 129 is composed of a heat pipe. This heat pipe is made of a metallic pipe of copper or aluminum in which water or alcohol is tightly accommodated. Alternatively, this heat pipe is made of a pipe, the inside of which is covered with capillary components, in which water or alcohol is tightly accommodated. After the completion of transfer, residual toner is removed from the surface of the photoreceptor drum 110 by the cleaner 134. The cleaner 134 includes: a cleaner blade 135, fur brush 136, beating rod 137, and toner ejecting screw 138.

When the background voltage and the adhering toner voltage are measured by the electric potential sensor 10 in this apparatus, it is possible to judge whether or not a two-color image can be normally printed, in the initial operating process in which the drum 110 is rotated by a predetermined number of revolutions.

In this embodiment, one-component nonmagnetic toner is used in both color development and black development. However, two-component magnetic developer may be used in one of color development and black development, and one-component magnetic developer may be used for black development. From the viewpoint of the design of thermal efficiency, it is preferable that the transfer and fixing section in which the transfer belt is used is arranged in an upper portion of the photoreceptor drum. It is possible to change the design in the above manner.

As described above, the present invention is to provide a color image forming apparatus and a color image forming method thereof including the means of: a latent image forming means (latent image forming process) for forming an electrostatic latent image having at least three electric potential levels, on the first recording body; a developing means (developing process) for developing a latent image to obtain at least a two-color toner image using color toners, the polarities of which are different from each other; a transfer means (transfer process) for transferring the toner image onto the second recording body; and a cleaning means (cleaning process) for removing residual toner and residual electric charge after the completion of transfer. When the above processes are repeated, color images can be continuously formed by the color image forming apparatus.

The image forming apparatus of the present invention includes a means for judging a recording condition in which no fringe image different from the information to be originally recorded is generated. Specifically, the image forming apparatus includes: an electric potential sensor to measure the background surface electric potential of the photoreceptor; a toner sensor to measure a quantity of toner adhering to the background; and a toner electric charge sensor. In the image forming process, there is provided an initial operating process in which the operation is repeated by a predetermined number of revolutions without transferring a toner image to the second recording body before the start of recording. In accordance with the result of judgment obtained in the initial operating process, printing is started. Due to the foregoing, no fringe image is generated in the process of color image formation. Accordingly, there is no possibility that an image different from the information to be originally recorded is developed. Therefore, normal printing operation can be continued over a long period of time. For this reason, it is unnecessary to confirm a printed image by conducting an actual printing operation. Therefore, sheets of recording paper and toner are not wasted, and time can be saved to start a normal printing operation.

What is claimed is:

1. A color image forming apparatus comprising:

latent image forming means for forming an electrostatic latent image having at least three electric potential levels, on a first recording body;

developing means for developing the latent image with toner, the polarity of which is different from that of the latent image, so as to form at least a two-color toner image;

transfer means for transferring the toner image on a second recording body;

cleaning means for removing residual toner and electric charge from the first recording body, wherein a color image is continuously formed by said latent image forming means, said developing means, said transfer means and said cleaning means, surface electric potential measuring means for measuring a surface electric potential in a region outside the latent image forming region on the first recording body;

comparing means for comparing a measured value measured by said surface electric potential measuring means with a predetermined value of the surface electric potential; and control means for controlling the start of color image formation on a recording sheet when the measured value is lower than the predetermined value as a result of the comparison.

2. A color image forming apparatus according to claim 1, wherein the predetermined value of the surface electric potential corresponds to about ½ of the highest electric potential level of the three electric potential levels of the electrostatic latent image formed on the first recording body.

3. A color image forming apparatus comprising:

latent image forming means for forming an electrostatic latent image having at least three electric potential levels, on a first recording body;

developing means for developing the latent image with color toner, the polarity of which is different from that of the latent image, so as to form at least a two-color toner image;

transfer means for transferring the toner image on a second recording body;

cleaning means for removing residual toner and electric charge from the first recording body, wherein a color image is continuously formed by said latent image forming means, said developing means, said transfer means and said cleaning means;

toner adhesion quantity measuring means for measuring a quantity of adhering toner in a region outside the latent image forming region on the first recording body;

comparing means for comparing a measured value measured by said toner adhesion quantity measuring means with a predetermined value of the quantity of adhering toner; and control means for controlling the start of color image formation on a recording sheet when the measured value is lower than the predetermined value as a result of the comparison.

4. A method of forming a color image comprising the steps of:

forming an electrostatic latent image having at least three electric potential levels, on a first recording body;

developing the latent image with toner, the polarity of which is different from that of the latent image, so as to form at least a two-color toner image;

transferring the toner image on a second recording body;

removing residual toner and electric charge from the first recording body, wherein color images are continuously formed when the processes are successively repeated, measuring a surface electric potential in a region outside the latent image forming region on the first recording body;

comparing a measured value measured by the surface electric potential measuring process with a predetermined value of the surface electric potential; and controlling the start of color image formation on a recording sheet when the measured value is lower than the predetermined value as a result of the comparison.

5. A color image forming method according to claim 4, wherein the predetermined value of the surface electric potential corresponds to about ½ of the highest electric potential level of the three electric potential levels of the electrostatic latent image formed on the first recording body.

6. A method of forming a color image comprising the steps of:

forming an electrostatic latent image having at least three electric potential levels, on a first recording body;

developing the latent image with toner, the polarity of which is different from that of the latent image, so as to form at least a two-color toner image;

transferring the toner image on a second recording body;

removing residual toner and electric charge from the first recording body, wherein color images are continuously formed when the processes are successively repeated, measuring a quantity of adhering toner in a region outside the latent image forming region on the first recording body;

comparing a measured value measured by the toner adhesion quantity measuring process with a predetermined value of a quantity of adhering toner; and controlling the start of color image formation on a recording sheet when the measured value is lower than the predetermined value as a result of the comparison.

* * * * *